US007517629B2

(12) United States Patent
Kobayashi et al.

(10) Patent No.: US 7,517,629 B2
(45) **Date of Patent: *Apr. 14, 2009**

(54) IMAGE FORMING METHOD

(75) Inventors: Nobuaki Kobayashi, Tokyo (JP); Masao Asano, Tokyo (JP); Hiroshi Yamazaki, Tokyo (JP)

(73) Assignee: Konica Minolta Business Technologies, Inc. (JP)

( * ) Notice: Subject to any disclaimer, the term of this patent is extended or adjusted under 35 U.S.C. 154(b) by 337 days.

This patent is subject to a terminal disclaimer.

(21) Appl. No.: 10/926,195

(22) Filed: Aug. 24, 2004

(65) Prior Publication Data

US 2005/0084787 A1 Apr. 21, 2005

(51) Int. Cl.
*G03G 21/00* (2006.01)

(52) U.S. Cl. ..... 430/119.71; 430/119.85; 430/119.84

(58) Field of Classification Search ..... 430/125, 430/133, 134, 119.71, 119.84, 119.86; 399/174, 399/175, 176

See application file for complete search history.

(56) References Cited

U.S. PATENT DOCUMENTS

| | | | | |
|---|---|---|---|---|
| 5,008,706 | A * | 4/1991 | Ohmori et al. | 399/174 |
| 5,351,109 | A * | 9/1994 | Haneda | 399/175 |
| 5,363,176 | A * | 11/1994 | Ishihara et al. | 399/176 |
| 6,063,532 | A * | 5/2000 | Miyake | 430/56 |
| 6,183,926 | B1 | 2/2001 | Kuroda et al. | |
| 6,296,980 | B1 * | 10/2001 | Oshiba et al. | 430/110.3 |
| 6,686,114 | B2 * | 2/2004 | Sakon et al. | 430/123.42 |
| 6,699,631 | B2 * | 3/2004 | Miyamoto et al. | 430/56 |
| 6,844,124 | B2 * | 1/2005 | Ikuno et al. | 430/58.7 |
| 7,316,876 | B2 * | 1/2008 | Kobayashi | 430/60 |
| 2003/0190547 | A1 * | 10/2003 | Kobayashi et al. | 430/125 |

FOREIGN PATENT DOCUMENTS

| | | | |
|---|---|---|---|
| JP | 08314159 | A * | 11/1996 |
| JP | 2001-242682 | | 9/2001 |
| JP | 2001-281906 | | 10/2001 |
| JP | 2003-207908 | | 7/2003 |

OTHER PUBLICATIONS

Diamond, Arthur S & David Weiss (eds.) Handbook of Imaging Materials. New York: Marcel-Dekker, Inc. (Nov. 2001) pp. 173-204.*
Office Action (English Translation) in Japanese counterpart application.

* cited by examiner

*Primary Examiner*—Christopher RoDee
(74) *Attorney, Agent, or Firm*—Squire, Sanders & Dempsey L.L.P.

(57) ABSTRACT

A method of forming a toner image employing a photoreceptor is described. The photoreceptor comprises a photosensitive layer on a cylindrical conductive substrate, Formula (1) and Formula (2) are held, $$0<P_{max}<2P \quad \text{Formula (1)}$$

$$2\leqq(P_{max}/D)\times100\leqq50 \quad \text{Formula (2)}$$

wherein P (μm) is the average of the coating layer thickness in central section in the width direction of the photoreceptor, Pmax (μm) is average of the maximum value of the layer thickness out of the image forming region, and D (μm) is average of distance between point, at which said maximum value is obtained, and edge of the coating layer, and the toner contains 1.0 to 7.0 number % of toner particles having number based particle diameter not more than 3.17 μm based on whole number of toner particles, and number average toner particle diameter is 4-9 μm.

13 Claims, 8 Drawing Sheets

FIG. 2
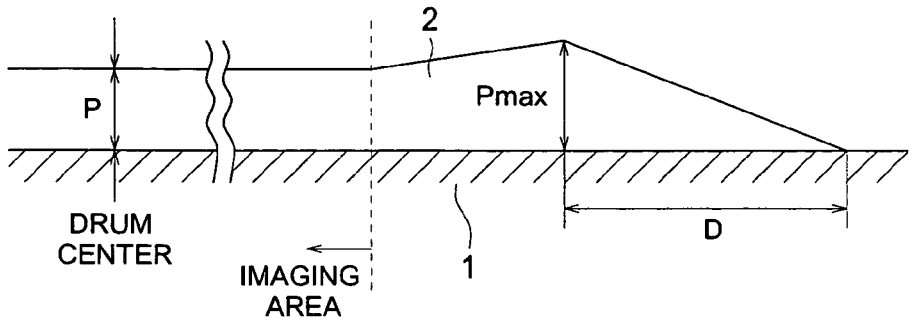
FIG. 3 ( a )
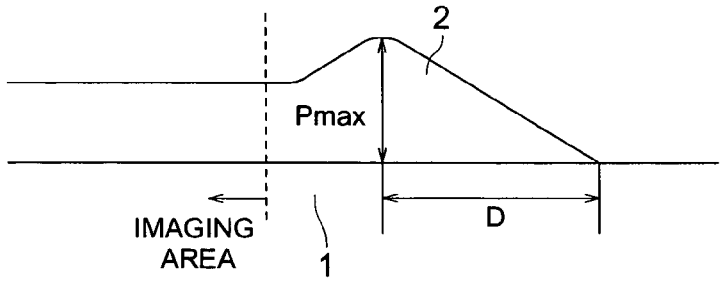
FIG. 3 ( b )
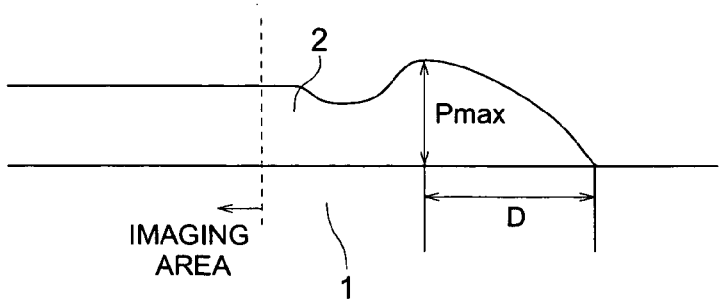
FIG. 3 ( c )
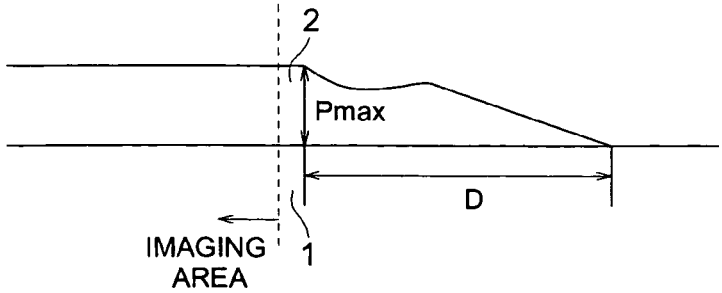

FIG. 8 ( a )
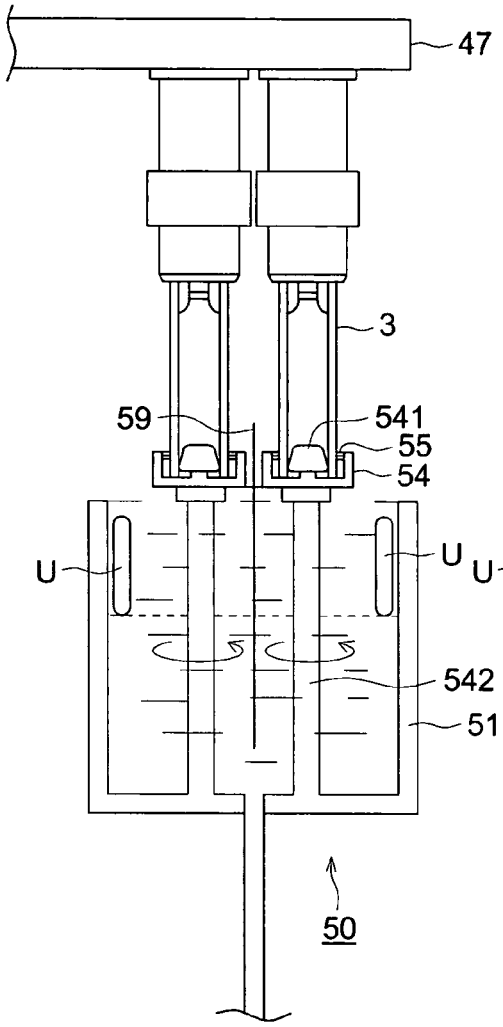
FIG. 8 ( b )
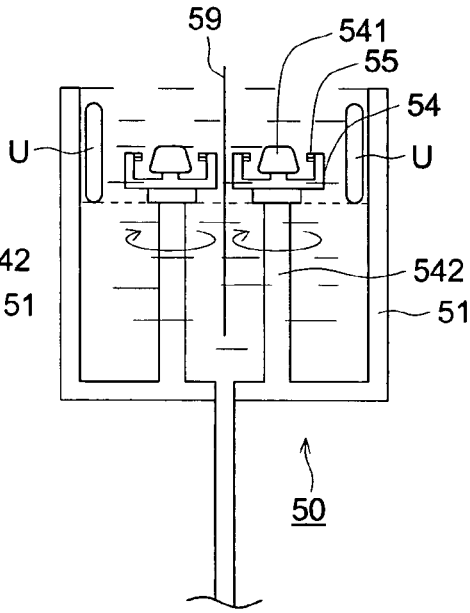
FIG. 9
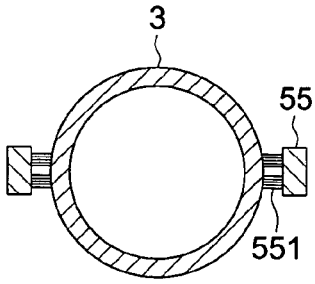

FIG. 10 ( a )
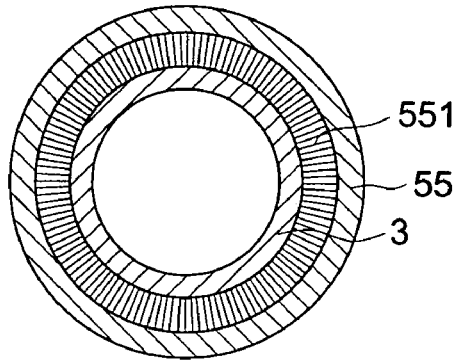
FIG. 10 ( b )
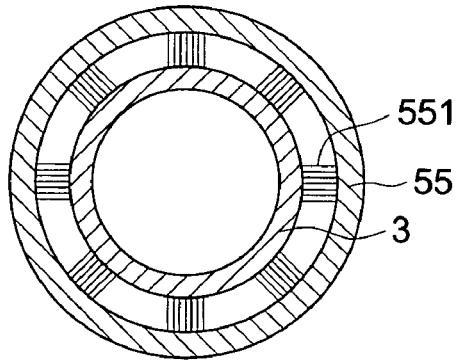
FIG. 10 ( c )
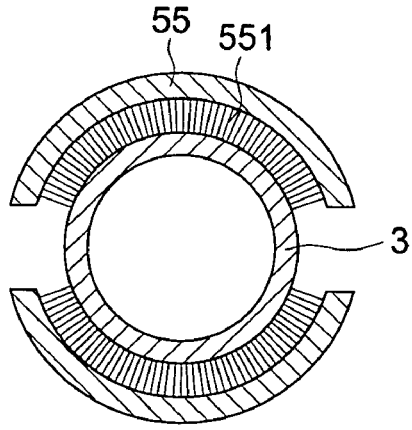

IMAGE FORMING METHOD

FIELD OF THE INVENTION

The present invention relates to an image forming method, an image forming apparatus, and a processing cartridge which are employed in copiers, laser beam printers, and facsimile machines, and to an electrophotographic photoreceptor (hereinafter occasionally referred simply as a photoreceptor).

BACKGROUND OF THE INVENTION

When a cylindrical electrophotographic photoreceptor (hereinafter occasionally referred to as a photoreceptor drum) is produced, a coating layer is generally formed by immersing a conductive cylindrical substrate into a photosensitive layer composition or coating compositions for an interlayer and a surface protective layer.

In such a case, since the conductive cylindrical substrate is immersed into a coating composition, a coating layer is formed on the entire surface of the conductive cylindrical body. When a photoreceptor drum, which is subjected to formation of the coating layer on the entire surface, is mounted on an electrophotographic image forming apparatus, occasionally, it becomes impossible to accurately carry out hitting due to peeling of the coating layer through contact with rollers which hits development units. Further, occasionally, it becomes impossible to use the photoreceptor drum as a contact point for grounding. As a result, it is preferable to remove the coating layer adhered on both edges of the photoreceptor drum.

Methods for removing such a coating layer include a method in which edges of a photoreceptor drum are immersed in a solvent and is subjected to vibration employing ultrasonic waves (Japanese Patent Application Open to Public Inspection No. 63-311357), a rubbing method employing a brush (Japanese Patent Application Open to Public Inspection Nos. 3-60782, 4-141663, 5-142789, 10-207084, 11-184100, and 11-194509), and in addition, a removing method employing tape.

For example, a method (Japanese Patent Application Open to Public Inspection No. 6-138670) is known in which tape which is comprised of thermally fusible type non-woven fabric is successively unwound, and the resulting tape is impregnated with solvent and thereafter, the impregnated tape comes into contact with a photoreceptor drum, thereby the removal is carried out. A method (Japanese Patent Application Open to Public Inspection No. 9-281725) is also known in which tape comprised of non-woven fabric, having an uneven structure on one surface, is employed.

Based on the investigations performed by the inventors of the present invention, however, in any methods, the following problems were found. Edges of the coating layer of a photoreceptor drum, in which the coating layer had been removed, tended to peel off. Insufficient cleaning occurred due to accumulation of toner at the edges in which the coating layer had been removed and toner scattering occurred, resulting in staining of the interior of the apparatus. Due to those, durability of the photoreceptor drum as well as cleaning member (such as cleaning means) degrades. As a result, it has been demanded that edges of the coating layer are shaped so that such problems do not occur.

Particularly, during the repeated use at high temperature and high humidity, toner is adhere-accumulated at the edges of the photoreceptor, whereby the torque between the cleaning blade and the photoreceptor varies, resulting in peeling of the coating layer at edges. Particularly, when peeling occurs, or coagulated toner which adheres to the aforesaid portion is mixed with developer as foreign matter, insufficient charging as well as insufficient cleaning results in black spots, whereby image quality is occasionally degraded.

Particularly, in recent years, in order to utilize excellent image quality which is an advantage of the electrophotographic image forming method, and to further improve the image quality, development toner, comprised of smaller size particles with uniform shape, has been commonly employed. In such cases, the aforesaid problems are more pronounced.

When a toner having smaller particle size are employed in combination with a photoreceptor, photosensitive coating at the end portion of which has been removed by wiping, wave-like cleaning defect is found at center of image forming area. The defect is supposed to be caused by shape of end portion of the photoreceptor. However it appears at the center portion of image forming area as fog of fine mottle, and step uneven image may appear even after the final image.

SUMMARY OF THE INVENTION

The present invention and the embodiments thereof will now be described.

A method of forming a toner image, comprising:

electrically charging a photoreceptor;

imagewise exposing the photoreceptor so that a latent image is formed on the photoreceptor;

developing the latent image with toner so that a toner image is formed on the photoreceptor;

transferring the toner image on an image forming material; and removing a residual toner on said electrophotographic photoreceptor; wherein electrically charging a photoreceptor is conducted by a charging member being brought into contact with the photoreceptor, and the photoreceptor comprises a photosensitive layer on a cylindrical conductive substrate, Formula (1) and Formula (2) are held, $$0<\mathrm{Pmax}<2\mathrm{P} \qquad \text{Formula (1)}$$

$$2\leqq(P\mathrm{max}/D)\times100\leqq50 \qquad \text{Formula (2)}$$

wherein P (μm) is the average of the coating layer thickness in central section in the width direction of the photoreceptor, Pmax (μm) is average of the maximum value of the layer thickness out of the image forming region, and D (μm) is average of distance between point, at which said maximum value is obtained, and edge of the coating layer, and the toner contains 1.0 to 7.0 number % of toner particles having number based particle diameter not more than 3.17 μm based on whole number of toner particles, and number average toner particle diameter is 4-9 μm.

The toner employed in the invention preferably satisfies the following condition.

The variation coefficient of said shape coefficient is not more than 16 percent.

A number variation coefficient in the toner number size distribution is not more than 27 percent.

The toner contains not less than 65 number % of toner particles having shape coefficient of 1.0-1.6 based on whole number of toner particles.

The toner preferably contains not less than 65 number % of toner particles having shape coefficient of 1.2-1.6 based on whole number of toner particles.

Variation coefficient of shape coefficient of the toner is preferably not more than 16%.

A number ratio of toner particles having no corners is 65 percent or more.

In a number based histogram, in which natural logarithm lnE is taken as the abscissa and said abscissa is divided into a plurality of classes at an interval of 0.23, a toner is preferred, which exhibits at least 70 percent of the sum (M) of the relative frequency ($m_1$) of toner particles included in the highest frequency class, and the relative frequency ($m_2$) of toner particles included in the second highest frequency class. E is diameter of toner particles (in μm)

The toner is preferably prepared by forming particles in an aqueous medium.

The toner is preferably prepared by coagulating and fusing resin particles in an aqueous medium.

The photoreceptor has a layer which is preferably prepared by coating a composition comprising a photosensitive material and removing a part of the layer.

A part of the photosensitive layer is removed preferably by making a rubbing means brought into contact with the photosensitive layer.

Preferable rubbing means is a brush or a tape.

The residual toner on said electrophotographic photoreceptor is removed preferably by urethane blade cleaning means.

Other embodiments of the invention are described.

An image forming method employing a photoreceptor and comprising a charging process, an exposure process, a development process employing a developer comprising toner, a toner transfer process, and a process to remove a residual toner on said electrophotographic photoreceptor employing as cleaning means, and the photoreceptor having at least a photosensitive layer on a cylindrical conductive substrate, which is brought into contact with a rubbing means to removal a part of the coating layer having an excess thickness, wherein both Formula (1) and Formula (2) described below are held and the variation coefficient of the shape factor of said toner is less than or equal to 16 percent.

$$0<P_{max}<2P \quad \text{Formula (1)}$$

$$2\leqq(P_{max}/D)\times100\leqq50 \quad \text{Formula (2)}$$

wherein P (μm) is the average of the coating layer thickness in the central section in the width direction of said photoreceptor, Pmax (μm) is the average of the maximum value of the layer thickness out of the image forming region, and D (μm) is the average of the distance between the point, at which said maximum value is obtained, and the edge of the coating layer, and number average toner particle diameter is 4-9 μm, and the toner contains 1.0 to 7.0 number % of toner particles having number based particle diameter not more than 3.07 μm based on whole number of toner particles.

A processing cartridge wherein any of at least a charging means, an exposure means, a development means, a transfer means, and a cleaning means are combined with an electrophotographic photoreceptor and is structured so as to be capable of being integrally and removably attached.

The image forming method preferably further comprises a toner recycle device.

BRIEF DESCRIPTION OF THE DRAWINGS

FIG. 2 is a schematic enlarged cross-sectional view of the edge of a photosensitive layer.

FIGS. 3(*a*), 3(*b*), and 3(*c*) each is a microscopic cross-sectional view showing a structure of the portion in which a photosensitive layer is peeled off by rubbing.

FIG. 8 is a cross-sectional view showing a coating layer removing apparatus employing a brush.

FIG. 9 is a cross-sectional view showing a contact state of a photoreceptor drum with a rubbing member.

FIGS. 10(*a*), 10(*b*) and 10(*c*) each is a view showing one embodiment of a rubbing member.

DETAILED DESCRIPTION OF THE INVENTION

Requisites and terms in the present invention will now be described. First, the coating layer, as described herein, refers all layers coated onto a cylindrical conductive substrate, as required, such as a photosensitive layer comprising a charge generating layer and a charge transport layer as a function separation type photoreceptor, an interlayer, and a surface protective layer.

Toner employed in this invention contains 1.0-7.0%, preferably 1.0-4.5%, by number of toner particles having number based particle diameter not more than 3.17 μm based on whole number of toner particles. Toners having such particle condition are suitable for minimizing disadvantage such as abrasion of cleaning blade or photoreceptor, vibration of cleaning blade, and toner particles passed through between the photoreceptor and cleaning blade.

The toner has preferably a number average particle diameter of 4-9 μm, to obtain high level image characteristics, such as good reproduction of half tone image and fine lines or fine dots.

Condition of toner particle shape or particle size and its distribution can be controlled by preparation method, for example, concentration of coagulant or salting-out agent, addition amount of an organic solvent, period of fusing time, composition of polymer and so on.

A concrete example to prepare toner particles containing 1.0 to 7.0 number % of toner particles having number based particle diameter not more than 3.17 μm is a method in which monomers are polymerized in an aqueous medium and resin particles are coagulated/fused in an aqueous medium.

The calculation of the particle diameter distribution of a toner and the measurement of its number-average particle diameter can be made by means of a Coulter counter TA-II, a Coulter Multisizer, an SLAD 1000 (a particle diameter measuring instrument of a laser diffraction type manufactured by Shimadzu Corporation), or the like.

In the measurement of the above-mentioned number-average particle diameter, a Coulter Multisizer was used connected to an interface for outputting the particle diameter distribution (manufactured by NIKKAKI Corp.) and a personal computer.

Image forming method, image forming apparatus, devices or other components are described.

An electrophotographic photoreceptor will now be described with reference to FIGS. 1(*a*), 1(*b*), and 1(*c*).

Figure 1:
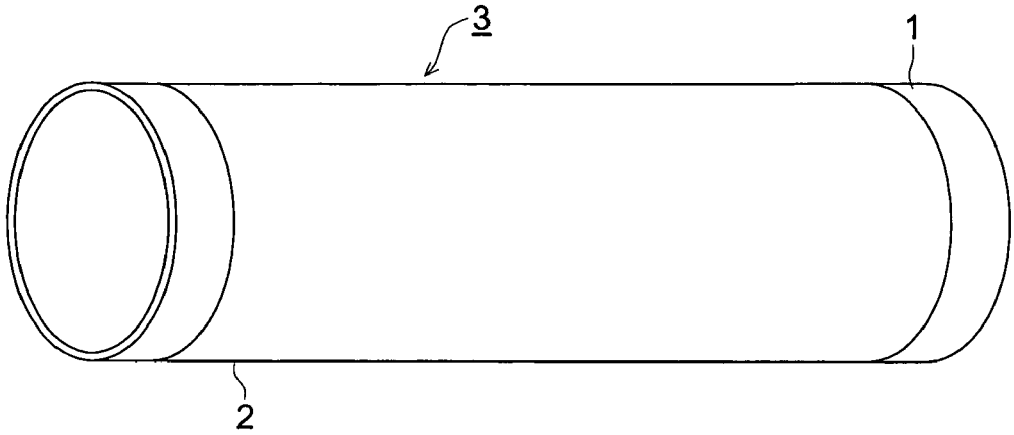
FIGS. 1(*a*), 1(*b*), and 1(*c*) each is view showing an electrophotographic photoreceptor drum and a view describing the specified values employed in the present invention.
Figure 1:
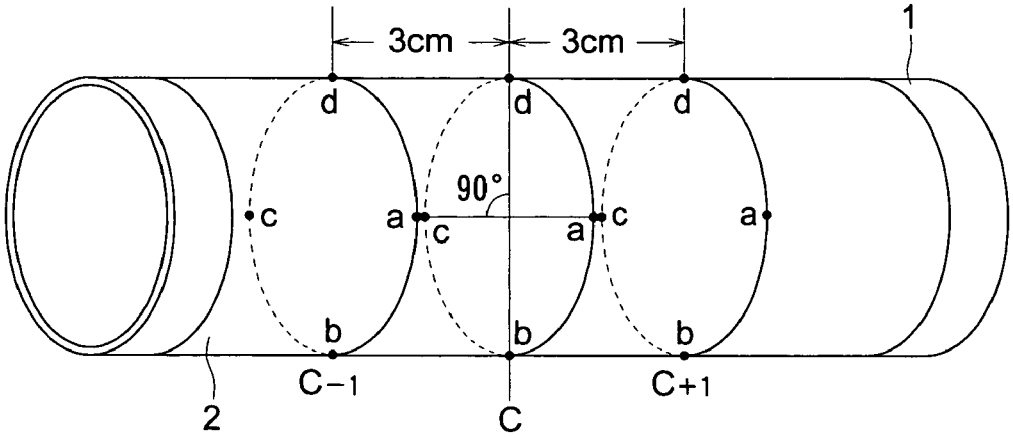
Figure 1:
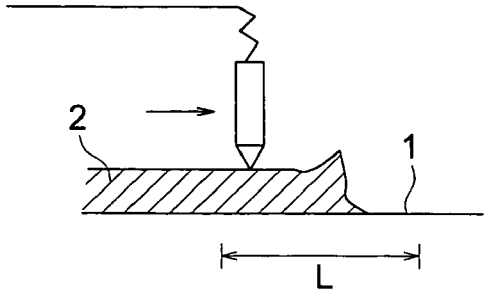

The photoreceptor drum 3 is shaped as shown in the perspective view of FIG. 1(*a*). A photosensitive layer and if desired, coating layers such as an interlayer and a surface protective layer are provided on the surface of drum shaped conductive substrate 1. It is necessary that both edges of the layer on the photoreceptor drum are completely peeled off and the edge shape is also critical.

A measurement method of average P (in μm) of the layer thickness in the central section of the photosensitive layer is described.

Average P of the layer thickness in the central section of the photosensitive layer will now be described with reference to FIG. 1(*b*). The thickness at 12 positions is measured, that is, positions a, b, c, and d, at the right angle with each other, of cross-section C in the center, and cross-sections $C_{-1}$ and $C_{+1}$, which are 3 cm apart from C. The resulting average is designated as average P of the layer thickness of the center section of the photosensitive layer. The aforesaid layer thickness was measured employing an eddy-current type layer thickness meter EDDY560C (manufactured by Helmut Fischer GMBT Co.).

The shape of the layer thickness of the coating layer edge was measured employing a continuous layer thickness measurement method described below.

As shown in FIG. 1(*c*), one edge of the coating layer to be measured is scanned. In such a case, as shown in FIG. 1(*c*), it is necessary that measurement length L includes the image forming region or the portion including the region of coating layer 2 having the same layer thickness as the image forming region and the exposed portion of conductive substrate 1. Practical measurement length L varies depending on the length of the conductive substrate, but is, for example, approximately 5 mm as standard.

In the same manner as shown in FIG. 1(*b*), 4 positions in the right angle with each other on the cross-section of the cylindrical conductive substrate are measured, and the resulting average is represented by Pmax. The distance to the edge of the coating layer is measured and the resultant average is represented by D. By plotting Pmax versus D, a profile is obtained as shower in FIG. 2. In addition, the other edge of the drum is measured in the same manner and the average is calculated. It is necessary that the values of each of both edges satisfy Formulas (1) and (2).

The aforesaid continuous layer thickness measurement was performed employing a layer thickness measurement apparatus Surfcom (manufactured by Kosaka Laboratory Ltd.), under the measurement mode of cross-section curve.

In practice, it is not easy that a coating layer is provided on the surface of a drum-shaped conductive substrate, and the surface of the conductive substrate is exposed by completely removing the coating layer at both edges. A method is developed in which the removal is carried out employing a solvent impregnated brush or tape. Methods will be detailed below. Even though these methods are employed, it has been found that problems may occur.

Even though the coating layer is removed employing the aforesaid method, the resulting edge is shaped as shown by the schematic enlarged cross-sectional view in FIG. 2.

In FIG. 2, coating layer 2, such as a photosensitive layer and the like, is applied onto the surface of conductive substrate 1. Pmax is the average of the maximum layer thickness in the exterior of the image forming region (hereinafter occasionally referred to simply as an image region), and P is the average layer thickness of the central section of the drum. Further, D is the average distance from the Pmax position to the region in which the surface of the conductive substrate is exposed by completely peeling the coating layer (in the present invention, μm is employed as the unit).

As shown in FIG. 2, when the surface of the photoreceptor drum is microscopically viewed, the layer thickness of the photosensitive layer in the central section of the drum maintains uniform values and commonly exhibits the tentatively specified layer thickens of 15 to 50 μm. However, as approaching the portion at both edges which have been subjected to removal of the coating layer, the layer thickness becomes non-uniform. For example, as shown in FIG. 2, the thickness increases and then gradually decreases.

There are several shapes of the portion in which the photosensitive layer is removed by rubbing. FIG. 3 shows some of microscopic cross-sectional shapes as a reference. FIG. 3(*a*) shows a shape which is analogous to that described in FIG. 2. FIG. 3(*b*) shows a shape in which prior to reaching Pmax position from the uniform layer thickness section, the layer thickness becomes less than that of the uniform layer thickness section and subsequently, the layer thickness increases to Pmax larger than P, and then decreases gradually. FIG. 3(*c*) shows a shape in which even though the layer thickness does not decrease at a definite ratio, at the edge of the photosensitive layer, there is no particular portion which exhibits larger layer thickness than P, the layer thickness gradually decreases, and finally the surface of the electronically conductive substrate is exposed.

Figure 4:
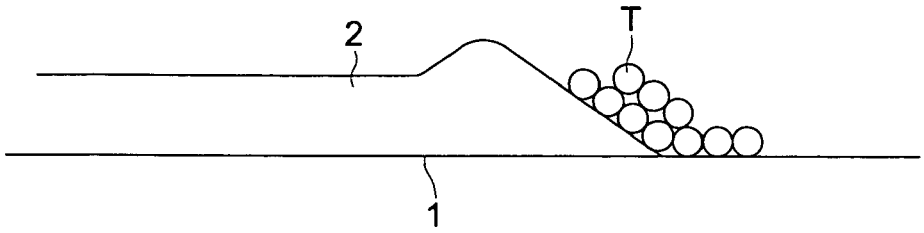
FIG. 4 is a conceptual cross-sectional view showing a state of toner particle accumulation or of adhesion of coagulated materials.

It is not known that these shapes are formed under any specified rubbing and removing conditions. However, problems occur due to excessive shape variations of the portion. Reasons are as follows. As shown in the schematic cross-sectional view of FIG. 4, in this portion, toner accumulates or coagulated materials adhere, and further, the coating layer peels off from this portion, resulting in various types of problems. Namely, it is seen that toner T adheres to the edge of coating layer 2. Further, it is found that this tends to occur as Pmax value increases and Pmax/D value increases.

Figure 5:
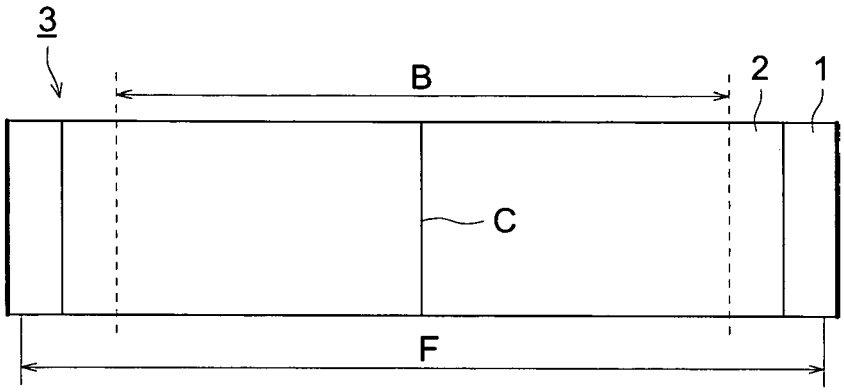
FIG. 5 is a view showing the cleaning region of a photoreceptor drum.

Reasons will be described utilizing the case of cleaning. As shown in FIG. 5, it will be well understood when the cleaning region is taken into account.

Photoreceptor drum 3 comprises conductive substrate 1 having thereon coating layer 2. Of these, the portion, which is employed for image formation, is region B (an image forming region) which is subjected to contact or facing with the magnetic brush of the development unit. Further, the portion, which is subjected to cleaning, is region F which is brought into contact with cleaning members (in many cases, cleaning blades). Region B is within the region which does not exhibit effects of layer thickness variation due to removal of the coating layer, and region F includes the region in which the photosensitive layer is completely peeled off. Naturally, the photosensitive layer on the photoreceptor drum is wider than aforesaid region B and narrower than region F, and is coated to a certain position between those. As noticed above, the edge is affected by the removal of the coating layer and its layer thickness is locally varied resulting in non-uniform thickness. As the local variation of the edge increases, more toner adheres or the resulting portion tends to be peeled off due to stress given by the cleaning blade. As a result, problems tend to occur. C refers to the central section in the width direction of the electrophotographic photoreceptor drum.

This situation is the entirely same as for a charging roller and a charging brush in the charging process. The foregoing is easily understood when the aforesaid cleaning blade is replaced with the charging roller and the cleaning brush.

Generally, Pmax is from 10 to 60 μm, and P is from 15 to 35 μm. It is necessary that a value (Pmax/D)×100 is adjusted in 2 to 50. When Pmax exceeds 60 μm, peeling tends to occur and coating layer powder tends to be adhered onto the image section, whereby image problems tend to occur. When (Pmax/D)×100 is less than 2, production difficulties occur due to uneasy machining, while it exceeds 50, toner staining increases or adhesion of the edge of the coating layer to conductive substrate 1 lowers.

Coating layer on the photoreceptor drum can be removed stably by tape or brush, which will be described below.

Achieving means to control the edge shape of the photoreceptor of the present invention include methods which control tape materials, tape providing methods, tape edge shape, brush materials, solvent compositions, removal time, removed layer thickness, and the swelling state prior to removing the coating layer. Of these, when the swelling state prior to removal, tape providing methods, brush materials, and solvent types are controlled, the desired edge shape is relatively easily formed.

Solvents which are employed during removal of the present invention vary depending on the types of coating layers, but include, for example, ether based, alcohol based, chlorine based, and ketone based solvents such as tetrahydrofuran, methanol, chloroform, methylene chloride, MEK (methyl ethyl ketone), acetone, and the like, and mixtures thereof.

The embodiments of coating layer removal will now be described with reference to drawings.

(1) Removal Method Employing Wiping-Off Tape

Figure 6:
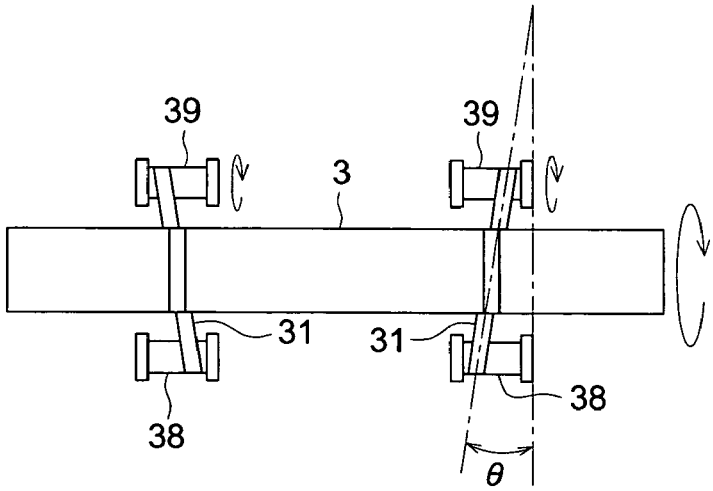
FIG. 6 is a schematic view showing that wiping-off tape is set on a photoreceptor drum while inclined.

FIG. 6 is a schematic view showing that wiping-off tape is set on a photoreceptor so as to form an inclination angle θ of at least 0 degree.

In FIG. 6, numeral 31 is the wiping-off tape, 3 is the photoreceptor drum, 38 is a master roller, 39 is a winding roller and, θ is an inclination angle.

The wiping-off tape is brought into contact with the edge of the photoreceptor drum. As shown in FIG. 5, the running direction of the aforesaid wiping-off tape is inclined so as to form an inclination angle θ of at least 0 degree with respect to the vertical plane to the longitudinal direction of photoreceptor drum 3. By so ding, it is possible that contact points between the wiping-off tape and the cross-section of the coating layer are minimized, and further, it is possible to wipe off pieces of the coating layer, which have been dissolved, so as not to be solidified at the edge. As a result, it is possible to smooth the edge without forming fins. By smoothing the edge, layer peeling from the edge is minimized and the formation of scars at the edge portion of the cleaning blade is also minimized.

<<Wiping-Off Tape>>

Materials for the wiping-off tape may be employed without any particular limitation, as long as they can be impregnated with employed solvents, are not damaged by the employed solvents, and can endure tension during wiping-off. Specifically employed are synthetic fiber such as polyamide based fiber including nylon 6 fiber and nylon 66 fiber, polyester based fiber including polyethylene terephthalate fiber and polybutylene terephthalate fiber, acryl based fiber, polyolefin based fiber such as Vinylon fiber, vinylidene fiber, polyurethane fiber, fluorine fiber, aromatic polyamide fiber, polyethylene fiber, and polypropylene fiber; regenerated fiber such as rayon fiber; semi-synthetic fiber such as acetate fiber; inorganic fiber such as carbon fiber; plant fiber such as cotton fiber and bast fiber; and animal fiber such as wool.

<<Impregnating Solvents>>

Impregnating solvents which are employed for impregnating the wiping-off tape vary depending on the types of coating layers. However, they are not particularly limited as long as they can remove the coating layer while dissolving or swelling it. Employed as impregnating solvents may be those previously described.

A wiping-off method is a method in which the wiping-off tape is impregnated with solvents which dissolve or swell the coating layer and subsequently the resulting wiping-off tape comes into contact with the rotating photoreceptor drum, whereby the coating layer is wiped off.

The moving direction of the wiping-off tape is not particularly limited but is preferably the reverse direction against the rotation direction of the photoreceptor drum so that as wiping-off can be achieved over a short period.

Figure 7:
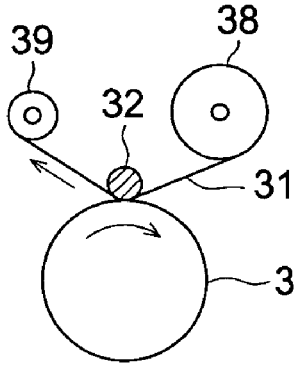
FIGS. 7(*a*), 7(*b*) and 7(*c*) each is a schematic view showing an example of a method in which wiping-off tape is brought into contact with a photoreceptor drum.
Figure 7:
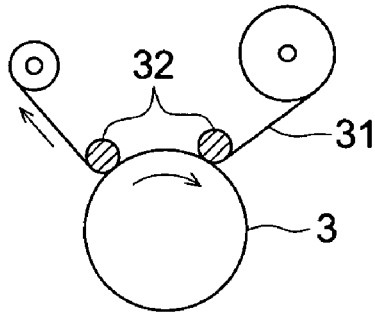
Figure 7:
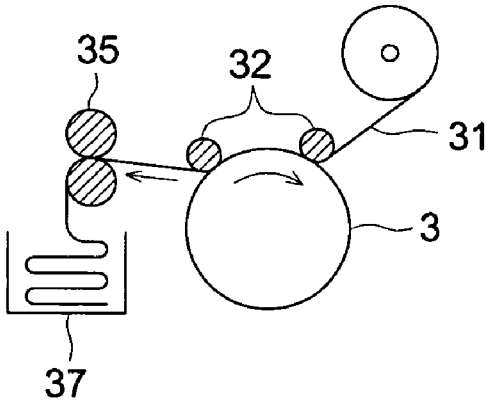

FIGS. 7(*a*)-(*c*) each shows a schematic views showing one example of the method in which the wiping-off tape comes into contact with the photoreceptor drum.

Listed as specific methods in which the wiping-off tape comes into contact with the edge of the coating layer of the photoreceptor drum may be FIGS. 7(*a*), 7(*b*), and 7(*c*).

FIG. 7(*a*) shows a method in which wiping-off tape 31 is subjected to definite tension between master roll 38 and winding roll 39 and is brought into contact with photoreceptor drum 3, employing a pressure contact roller 32. In order that running direction of wiping-off tape 31 is inclined so as to form an inclination angle θ of at least 0 degree, as shown in FIG. 6, the installation position of master roll 38 may be shifted optionally from that of winding roll 39 so as to form the desired angle.

FIG. 7(*b*) shows a method in which two pressure contact rollers 32, which are used in FIG. 7(*a*), are employed and wiping-off tape 31 is brought into contact with the photoreceptor drum.

FIG. 7(*c*) shows a method in which winding roll 39 in FIG. 7(*a*) is replaced with nip drive roller 35 and wiping-off tape 31, which has completed wiping-off, is recovered in recovery container 37. Wiping-off tape 31, which has completed wiping-off, is impregnated with solvents. Therefore, it is preferable to place wiping-off tape 31 in the recovery container so that solvents are not vaporized into a room.

(2) Peeling Method Employing a Brush

FIG. 8 is a cross-sectional view of coating layer removing apparatus 50, employing a brush. In FIG. 8, numeral 3 is a photoreceptor in which a coating layer is formed on the surface. The photoreceptor drum is held employing transport means 47 so as to be movable up and down and is brought into contact with rubbing member 55 provided with coating layer removing stand 54 (a coating layer removing means) in the coating layer removing apparatus. Coating layer removing stand 54 is also provided with sponge-like substrate holding member 541, and the conductive substrate of the photoreceptor drum is held at the bottom end employing the substrate holding stand and the rubbing member. Further, coating layer removing stand 54 is structured to be rotatable utilizing motor drive. Photoreceptor drum 3 is installed in the specified position, employing transport means 47 comprising a holding means (such as an O ring chuck and an air picker chuck) which holds the interior of the substrate, and the bottom end of photoreceptor drum 3 is brought into contact with rubbing member 55 (FIG. 8*a*).

In such a case, coating layer removing stand 54 is positioned above the liquid surface of solvent tank 51 which is a washing means. When residual solvents in the edge of the coating layer of the photoreceptor drum reaches less than or equal to 60 percent by weight, coating layer removing stand 54 starts rotating, and along with the rotation, the coating layer in the lower edge is wiped off by rubbing member 55. After wiping-off, the photoreceptor drum is lifted by transport means 47 (which also works as a separating means) and separated from coating layer removing stand 54. Thereafter, coating layer removing stand 54 is dipped (FIG. 8(*b*)) in solvents in solvent tank 51 which is a washing means, utilizing rotation of cylinder 542 (a moving means of the coating layer removing means) capable of moving coating layer removing stand 54 up and down, and the entire coating layer removing stand including the rubbing member is washed in the solvent tank, utilizing the combination of an ultrasonic cleaner, up and down movement and rotation of the coating layer removing stand, employing the cylinder.

Subsequently, the coating layer removing stand is lifted over the liquid surface, again employing rotation of cylinder 542 and is prepared for the subsequent coating layer removal. It is preferable that washing efficiency of the coating layer removing means is enhanced by installing ultrasonic vibrator U in the solvent tank. As shown in FIG. 8, when the coating layers of at least two base bodies are simultaneously removed, it is preferable that partition 59 is provided between the coating layer removing means so that defect formation due to splash during peeling the coating layer of each of photoreceptor drums 3 is minimized.

Material of the wipe-off member includes a brush, sponge, cloth and polymer fiber, and preferable example is a brush.

The brush is preferably comprised of nylon, polyethylene, polypropylene, and polyester. When brush hairs are planted onto coating layer removing stand 54, the size of a single hole is from about 0.5 to about 2 mm, and the interval between holes is from about 1 to about 3 mm. It is preferable that the entire width of the brush is determined corresponding to the width of the coating layer to be removed.

The rubbing member impregnated with solvents, as described in the present invention, refers to the member which bears solvents, even though its materials are not impregnated with solvents. The weight of the rubbing member impregnated with solvents is preferably from 105 to 200 parts by weight when the weight of the rubbing member which is not impregnated with solvents is 100 parts by weight.

FIG. 9 is a longitudinal sectional view showing the contact state of photoreceptor drum 3 with rubbing member 55. Photoreceptor drum 3 is brought into contact with brush 551 of the rubbing member.

FIGS. 10(*a*), 10(*b*) and 10(*c*) each shows one structure of rubbing member 55.

Figure 11:
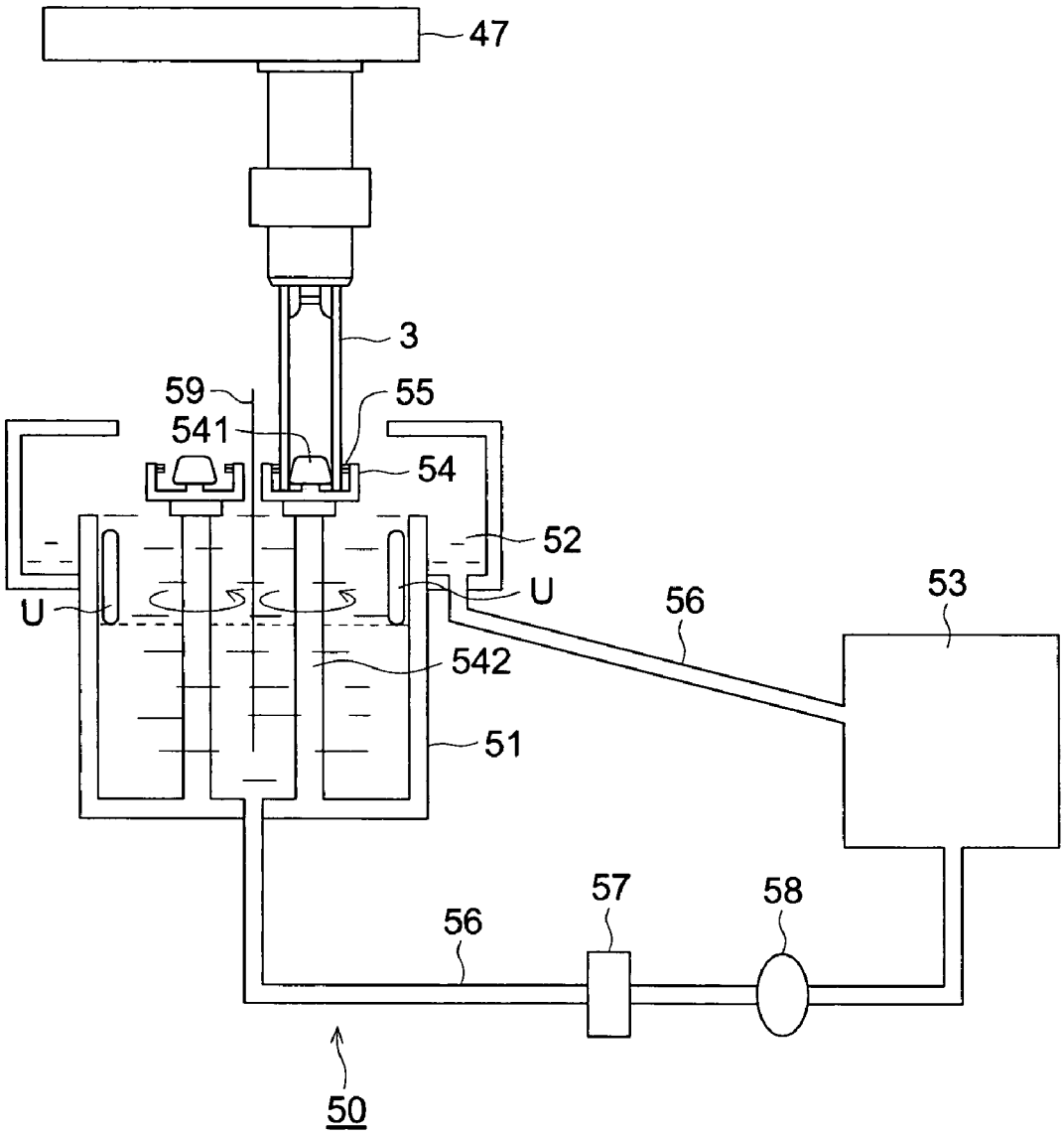
FIG. 11 is a view showing the entire structure of a coating layer removing apparatus.

FIG. 11 is a view showing the entire structure of coating layer removing apparatus 50.

Coating layer removing apparatus 50 is comprised of solvent tank 51, solvent overflow chamber 52, supply tank 53, coating layer removing stand 54, rubbing member 55, solvent circulation pipe 56, pump 57, filter 58, and transport means 47.

Coating layer removing stand 54 is attached with rubbing member 55 and substrate holding member 541. The photoreceptor drum is then firmly fixed and simultaneously, the rubbing member rotates being followed by rotation of coating layer removing stand 54, and the coating layer in the bottom edge of the photoreceptor drum is wiped off and removed. As shown in FIG. 11, coating layer removing stand 54 is structured so as to be movable to the interior as well as to the exterior of solvent tank 51 together with rubbing member 55, utilizing rotation of cylinder 542.

Further, solvents in the solvent tank is continuously circulated via solvent circulation pipe 56 from supply tank 53, and coating layer components are removed employing a filter which is provided at the intermediate position along solvent circulation pipe 56 so that the solvents can sufficiently wash the coating layer removing means.

3. Structure of Photoreceptor (1) Conductive Substrate (Conductive Support)

Employed as a conductive substrate, which is used to prepare the photoreceptor of the present invention, is a cylindrical conductive support. The cylindrical conductive support, as described herein, refers to a cylindrical support which meets requirement capable of continuously forming images with its rotation. Conductive supports, which are in the range of a straightness of less than or equal to 0.1 mm and a deviation of less than or equal to 0.1 mm, are preferred. When the straightness as well as the deviation exceeds the aforesaid range, it is difficult to form desired images.

Employed as conductive supports may be metal drums comprised of aluminum or nickel, plastic drums which are subjected to vacuum evaporation of tin oxides or indium oxides, or paper-plastic drums coated with conductive materials. The specific resistance of conductive supports is preferably less than or equal to $10^3$ Ωcm.

(2) Interlayer

The interlayer (UCL) employed in the present invention is provided between the conductive substrate and the photosensitive layer in order to enhance the adhesion of the aforesaid support and the aforesaid photosensitive layer and to minimize charge injection from the aforesaid support. Listed as materials of the aforesaid interlayer are polyamide resins, vinyl chloride resins, vinyl acetate resins, and copolymers comprising at least two repeating units of these resins. Of these, preferred as resins capable of minimizing an increase in residual potential during repeated use are polyamide resins. Further, the thickness of the interlayer comprised of these resins is preferably from 0.01 to 2.0 μm.

Further, listed as an interlayer which is most preferably employed in the present invention is one which employs curing metal resins which are prepared by thermally curing organic metal compounds such as silane coupling agents and titanium coupling agents. Thickness of the interlayer employing thermally curing organic metal compound is preferably from 0.01 to 2.0 μm.

Further, listed as another preferable interlayer is one comprising titanium oxide as well as binder resins, which is prepared by dispersing titanium oxide in a binder resin solution and coating the resulting dispersion. The thickness of the interlayer using titanium oxide is preferably from 0.1 to 15.0 μm.

The preferable photosensitive layer structure of the organic photoreceptor of the present invention will now be described.

(3) Photosensitive Layer

The photosensitive layer of the photoreceptor of the present invention may be comprised of a single layer provided with a charge generating function as well as a charge transport function, which is applied onto the aforesaid subbing layer. However, a more preferable structure is that the function of the photosensitive layer is achieved by dividing the layer into a charge generating layer (CGL) and a charge transport Layer (CTL). By utilizing a structure in which functions are separated, it is possible to control an increase in residual potential during repeated use to the minimal level and also easy to control other electrophotographic characteristics so as to achieve targets. A photoreceptor for negative charging is preferably structured so that the charge generating layer (CGL) is provided on the subbing layer and thereon the charge transport layer (CTL). In a photoreceptor for positive charging, the order of the aforesaid layer structure is reversed. The most preferable photosensitive layer structure is a photosensitive structure for negative charging, having a function separating structure.

The photosensitive layer structure of the function separation photoreceptor for negative charging will now be described.

<<Charge Generating Layer>>

The charge generating layer of the present invention comprises charge generating materials and binder resins and is formed by dispersing the charge generating materials in the binder resin solution and subsequently coating the resulting dispersion.

Employed as charge generating materials may be phthalocyanine compounds, which are preferably titanyl phthalocyanine compounds as well as hydroxyl gallium phthalocyanine compounds. Further, titanyl phthalocyanine compounds such as Y type and A type (β type) are preferred which are featured to have a main peak of Bragg angle 2θ with respect to Cu-kα characteristic X-ray (having a wavelength of 1.54 Å). Such oxytitanyl phthalocyanines are described in Japanese Patent Application Open to Public Inspection No. 10-069107. Further, these charge generating materials may be employed individually or in combination of at least two types and may be mixed with polycyclic quinones such as perylene pigments.

Listed as binder resins of the charge generating layer are, for example, polystyrene resins, polyethylene resins, polypropylene resins, acryl resins, methacryl resins, vinyl chloride resins, vinyl acetate resins, polyvinyl butyral resins, epoxy resins, polyurethane resins, phenol resins, polyester resins, alkyd resins, polycarbonate resins, silicone resins, melamine resins, copolymers (such as vinyl chloride-vinyl acetate copolymers and vinyl chlorides-vinyl acetate-maleic anhydride copolymers) comprising at least two of these resins, and polyvinylcarbazole resins, but the resins are not limited to these example.

It is preferable that the charge generating layer is formed in such a manner that a coating composition is prepared by dispersing charge generating materials in a solution prepared by dissolving binder resins in solvents while using a homogenizer; the resulting coating composition is coated at a definite layer thickness, employing a coater, and the resulting coating is dried.

Listed as solvents which are employed to dissolve binder resins employed for the charge generating layer and also employed for coating are, for example, toluene, xylene, methylene chloride, 1,2-dichloroethane, methyl ethyl ketone, cyclohexane, ethyl acetate, butyl acetate, methanol, ethanol, propanol, butanol, methyl cellosolve, ethyl cellosolve, tetrahydrofuran, 1,4-dioxane, 1,3-dioxolane, pyridine, and diethylamine, but the solvents are not limited to these examples.

Employed as means for dispersing charge generating materials may be ultrasonic homogenizers, ball mills, sand grinders, and homomixers, but the means are not limited to these examples.

Listed as coaters for forming the charge generating layer are, for example, dip coaters and ring coaters.

The blending ratio of charge generating materials to binder resins is preferably from 1 to 600 parts (hereinafter, "parts" is parts by weight) with respect to 100 parts of the binder resins, and is more preferably from 50 to 500 parts. The thickness of the charge generating layer varies depending on the characteristics of charge generating materials, the characteristics of binder resins, and the mixing ratio, but is preferably from 0.01 to 5.0 μm.

<<Charge Transport Layer>>

The charge transport layer of the present invention comprises charge transport materials as well as binder resins, and is formed by dissolving the charge transport materials in a binder resin solution and coating the resulting composition.

Employed as charge transport materials, other than those described in Japanese Patent Application No. 2000-360998, may be, for example, carbazole derivatives, oxazole derivatives, oxadiazole derivatives, thiazole derivatives, thiadiazole derivatives, triazole derivatives, imidazole derivatives, imidazolone derivatives, imidazoline derivatives, bisimidazoline derivatives, styryl compounds, hydrazone compounds, pyrazoline compounds, oxazolone derivatives, benzimidazole derivatives, quinazoline derivatives, benzofuran derivatives, acridine derivatives, phenazine derivatives, aminostilbene derivatives, triarylamine derivatives, phenylenediamine derivatives, stilbene derivatives, benzidine derivatives, poly-N-vinylcarbazole, poly-1-vinylpyrene and poly-9-vinylanthrathene. These may be employed in combination of at least two types.

Listed as binder resins for the charge transport layer are polycarbonate resins, polyacrylate resins, polyester resins, polystyrene resins, styrene-acrylonitrile copolymer resins, polymethacrylic acid ester resins, and styrene-methacrylic acid ester copolymer resins. Of these, polycarbonates are preferred. Further, polycarbonates comprised of BPA, BPZ, dimethyl BPA, and BPA-dimethyl BPA copolymers are preferred from the viewpoint of cracking, abrasion resistance, and charging characteristics.

It is preferable that the charge transport layer is formed as follows. A coating composition is prepared by dissolving charge transport materials in binder resins. The resulting coating composition is coated so as to achieve a definite coating thickness, employing a coater, and subsequently dried.

Listed as solvents employed for dissolving aforesaid binder resins and charge transport materials are, for example, toluene, xylene, methylene chloride, 1,2-dichloroethane, methyl ethyl ketone, cyclohexanone, ethyl acetate, butyl acetate, methanol, ethanol, propanol, butanol, tetrahydrofuran, 1,4-dioxane, 1,3-dioxolane, pyridine, and diethylamine, but the solvents are not limited to these.

The blending ratio of the charge transport materials to the binder resins is preferably from 10 to 500 parts (hereinafter, "parts" is parts by weight) with respect to 100 parts of the binder resins, and is more preferably from 20 to 100 parts.

The thickness of the charge transport layer varies depending on the characteristics of charge transport materials, the characteristics of binder resins, the characteristics of binder resins, and the mixing ratio, but is preferably from 10 to 100 μm, and is more preferably from 15 to 40 μm.

Further, antioxidants (AO agents), electron accepting materials (EA agents), and stabilizers may be incorporated in the charge transport layer. AO agents are preferred which are described in Japanese Patent Application No. 11-200135, while EA agents are preferred which are described in Japanese Patent Publication Open to Public Inspection Nos. 50-137543 and 58-76483.

(4) Protective Layer

In order to enhance durability, the protective layer may be provided on the charge transport layer. The protective layer utilizing siloxane based resins, described in each of Japanese Patent Publication Open to Public Inspection Nos. 9-190004, 10-095787, and 2000-171990, is preferred due to enhancement of its abrasion resistance. In the foregoing, the most preferable layer structure of the organic photoreceptor is exemplified. However, in the present invention, layer structures other than those, described above, may be employed.

(2) Preparation of Toner Employed in the Invention

Described next will be the preparation of toner which is employed in the present invention.

Producing Method of Toner

The toner can be produced by various methods. It is preferred to employ so-called polymerization method, which does not require a pulverization or classifying step, so as to obtain toner particles having uniform size.

The method includes a process preparing fine resin particles by a suspension polymerization method, or an emulsion polymerization method or a mini-emulsion polymerization method, a process of adding required emulsifier in a certain step, and coagulation and fusing step of the fine resin particles by adding a coagulant such as an organic solvent or salts.

(1) Suspension Polymerization

When the toner is produced by the suspension polymerization method, the production is performed by the following procedure. Various raw materials such as a colorant, a mold releasing agent according to necessity, a charge controlling agent and a polymerization initiator are added into a polymerizable monomer and dispersed or dissolved by a homogenizer, a sand mill, a sand grinder or a ultrasonic dispersing apparatus. The polymerizable monomer in which the raw materials are dissolved or dispersed is dispersed into a form of oil drops having a suitable size as toner particle by a homomixer or a homogenizer in an aqueous medium containing a dispersion stabilizing agent. Then the dispersion is moved into a reaction vessel having a stirring device with double stirring blades, and the polymerization reaction is progressed by heating. After finish of the reaction, the dispersion stabilizing agent is removed from the polymer particles and the polymer particles are filtered, washed and dried to prepare a toner. In the invention, the aqueous medium is a medium containing at least 50% by weight of water.

(2) Emulsion Polymerization

The toner according to the invention can be also obtained by salting-off/coagulating fine resin particles. For example, the methods described in JP O.P.I. Nos. 5-265252, 6-329947 and 9-15904 are applicable.

The toner can be produced by a method by which dispersed particles of constituting material such as resin particles and colorant or fine particles constituted by resin and colorant are associated several by several. Such the method is realized particularly by the following procedure: the particles are dispersed in water and the particles are salted-out by addition of a coagulation agent in an amount of larger than the critical coagulation concentration. At the same time, the particles are gradually grown by melt-adhesion of the particles by heating at a temperature higher than the glass transition point of the produced polymer. The particle growing is stopped by addition of a large amount of water when the particle size is reached at the prescribed diameter. Then the surface of the particle is made smooth by heating and stirring to control the shape of the particles. The particles containing water in a fluid state are dried by heating. Thus the toner can be produced. In the foregoing method, an infinitely water-miscible solvent such as alcohol may be added together with the coagulation agent.

(3) Composite Resin Particles Obtained by Multi-Step Polymerization

An example of composite resin particles prepared by a multi-step polymerization method, which is a representative preparation method of toner by an emulsion polymerization. An area other than the outermost layer of the composite resin particle preferably contains a releasing agent.

The production process comprises mainly, for example, the following processes:

1. A multi-step polymerizing process to obtain a composite resin which contains a releasing agent in an area other than the outermost layer, i.e., core area or inter layer.
2. A salting-out/coagulation process to produce a toner particle by salting-out/coagulating the compound resin particles and colored particles.
3. Filtering and washing processes to filter the toner particles from the toner particle dispersion and to remove an unnecessary substance such as the surfactant from the toner particles.
4. A drying process to dry the washed toner particles.
5. A process to add an exterior additive to the toner particles.

Each of the processes is described more in detail below.

(Multi-Step Polymerization Process)

The multi-step polymerization process is a process for preparing the composite resin particle having covering layer of polymer on a resin particle.

It is preferred from the viewpoint of the stability and the anti-crush strength of the obtained toner to apply the multi-step polymerization including three or more polymerization steps.

The two- and tree-step polymerization methods, which are representative examples, are described below.

(Two-Step Polymerization Method)

The two-step polymerization method is a method for producing the composite resin particle comprised of the central portion (core) containing the crystalline material comprising the high molecular weight resin and an outer layer (shell) comprising the low molecular weight resin.

Practically a monomer liquid is prepared by incorporating the crystalline material in a monomer, the monomer liquid is dispersed in an aqueous medium, such as an aqueous solution of a surfactant, in a form of oil drop, and the system is subjected to a polymerization treatment (the first polymerization step) to prepare a dispersion of a higher molecular weight resin particles each containing the crystalline material.

Next, a polymerization initiator and a monomer to form the lower molecular weight resin is added to the suspension of the resin articles, and the monomer L is subjected to a polymerization treatment (the second polymerization step) to form a covering layer composed of the lower molecular weight resin (a polymer of the monomer) onto the resin particle.

(Three-Step Polymerization Method)

The three-step polymerization method is a method for producing the composite resin particle comprised of the central portion (core) comprising the high molecular weight resin, the inter layer containing the crystalline material and the outer layer (shell) comprising the low molecular weight resin.

Practically a suspension of the resin particles prepared by the polymerization treatment (the first polymerization step) according to a usual procedure is added to an aqueous medium (an aqueous solution of a surfactant), and a monomer liquid prepared by incorporating the crystalline material in a monomer is dispersed in the aqueous medium. The aqueous dispersion system is subjected to a polymerization treatment (the second polymerization step) to form a covering layer (inter layer) comprising a resin (a polymer of the monomer) containing the crystalline material onto the surface of the resin particle (core particle). Thus a suspension of combined resin (higher molecular weight resin-middle molecular weight resin) particles is prepared.

Next, a polymerization initiator and a monomer to form the lower molecular weight resin is added to the dispersion of the combined resin particles, and the monomer is subjected to a polymerization treatment (the third polymerization step) to form a covering layer composed of the low molecular weight resin (a polymer of the monomer) onto the composite resin particle.

In the three-step polymerization method, the crystalline material can be finely and uniformly dispersed by applying a procedure, at the time of forming the inter layer on the resin particle.

The polymer is preferably obtained by polymerization in the aqueous medium. The crystalline material is incorporated in a monomer, and the obtained monomer liquid is dispersed in the aqueous medium as oil drop at the time of forming resin particles (core) or covering layer thereon (inter layer) containing the crystalline material, and resin particles containing a releasing agent can be obtained as latex particles by polymerization treatment with the addition of initiator.

The water based medium means one in which from 50 to 100 percent by weight of water, is incorporated. Herein, components other than water may include water-soluble organic solvents. Listed as examples are methanol, ethanol, isopropanol, butanol, acetone, methyl ethyl ketone, tetrahydrofuran, and the like. Of these, preferred are alcohol based organic solvents such as methanol, ethanol, isopropanol, butanol, and the like which do not dissolve resins.

Methods are preferred in which dispersion is carried out employing mechanical force. The monomer solution is preferably subjected to oil droplet dispersion (essentially an embodiment in a mini-emulsion method), employing mechanical force, especially into water based medium prepared by dissolving a surface active agent at a concentration of lower than its critical micelle concentration. An oil soluble polymerization initiator may be added to the monomer solution in place of a part or all of water soluble polymerization initiator.

In the usual emulsion polymerization method, the crystalline material dissolved in oil phase tends to desorb. On the other hand sufficient amount of the crystalline material can be incorporated in a resin particle or covered layer by the mini-emulsion method in which oil droplets are formed mechanically.

Herein, homogenizers to conduct oil droplet dispersion, employing mechanical forces, are not particularly limited, and include, for example, CLEARMIX, ultrasonic homogenizers, mechanical homogenizers, and Manton-Gaulin homogenizers and pressure type homogenizers. The diameter of dispersed particles is 10 to 1,000 nm, and is preferably 30 to 300 nm.

Emulsion polymerization, suspension polymerization seed emulsion etc. may be employed as the polymerization method to form resin particles or covered layer containing the crystalline material. These polymerization methods are also applied to forming resin particles (core particles) or covered layer which do not contain the crystalline material.

The particle diameter of composite particles obtained by the process (1) is preferably from 10 to 1,000 nm in terms of weight average diameter determined employing an electrophoresis light scattering photometer ELS-800•(produced by OTSUKA ELECTRONICS CO., LTD.).

Glass transition temperature (Tg) of the composite resin particles is preferably from 48 to 74° C., and more preferably from 52 to 64° C.

The Softening point of the composite resin particles is preferably from 95 to 140° C.

Salting-Out/Fusion Process

Salting-out/fusion process is a process to obtain toner particles having undefined shape (aspherical shape) in which the composite resin particles obtained by the foregoing process and colored particles are aggregated.

Salting-out/fusion process of the invention is that the processes of salting-out (coagulation of fine particles) and fusion (distinction of surface between the fine particles) occur simultaneously, or the processes of salting-out and fusion are induced simultaneously. Particles (composite resin particles and colored particles) must be subjected to coagulation in such a temperature condition as lower than the glass transition temperature (Tg) of the resin composing the composite resin particles so that the processes of salting-out (coagulation of fine particles) and fusion (distinction of surface between the fine particles) occur simultaneously.

Particles of additives incorporated within toner particles such as a charge control agent (particles having average diameter from 10 to 1,000 nm) may be added as well as the composite resin particles and the colored particles in the salting-out/fusion process. Surface of the colored particles may be modified by a surface modifier.

The colored particles are subjected to salting out/fusion process in a state that they are dispersed in water based medium. The water based medium to disperse the colored particles includes an aqueous solution dissolving a surfactant in concentration not less than critical micelle concentration (CMC).

Homogenizers employed in the dispersion of the colored particles include, for example, CLEARMIX, ultrasonic homogenizers, mechanical homogenizers, and Manton-Gaulin homogenizers and pressure type homogenizers.

In order to simultaneously carry out salting-out and fusion, it is required that salting agent (coagulant) is added to the dispersion of composite particles and colored particles in an amount not less than critical micelle concentration and they are heated to a temperature of the glass transition temperature (Tg) or higher of the resin constituting composite particles.

Suitable temperature for salting out/fusion is preferably from (Tg plus 10° C.) to (Tg plus 50° C.)., and more preferably from (Tg plus 15° C.) to (Tg plus 40° C.). An organic solvent which is dissolved in water infinitely may be added in order to conduct the salting out/fusion effectively.

(Filtration and Washing Process)

In the filtration and washing process, filtration is carried out in which said toner particles are collected from the toner particle dispersion, and washing is also carried out in which additives such as surface active agents, salting-out agents, and the like, are removed from the collected toner particles (a cake-like aggregate).

Herein, filtering methods are not particularly limited, and include a centrifugal separation method, a vacuum filtration method which is carried out employing Buchner funnel and the like, a filtration method which is carried out employing a filter press, and the like.

(Drying Process)

The washed toner particles are dried in this process.

Listed as dryers employed in this process may be spray dryers, vacuum freeze dryers, vacuum dryers, and the like. Further, standing tray dryers, movable tray dryers, fluidized-bed layer dryers, rotary dryers, stirring dryers, and the like are preferably employed.

It is proposed that the moisture content of dried toners is preferably not more than 5 percent by weight, and is more preferably not more than 2 percent by weight.

Further, when dried toner particles are aggregated due to weak attractive forces among particles, aggregates may be subjected to crushing treatment. Herein, employed as crushing devices may be mechanical a crushing devices such as a jet mill, a Henschel mixer, a coffee mill, a food processor, and the like.

The toner according to the invention is preferably produced by the following procedure, in which the compound resin particle is formed in the presence of no colorant, a dispersion of the colored particles is added to the dispersion of the compound resin particles and the compound resin particles and the colored particles are salted-out and coagulated.

In the foregoing procedure, the polymerization reaction is not inhibited since the preparation of the compound resin particle is performed in the system without colorant. Consequently, the anti-offset property is not deteriorated and contamination of the apparatus and the image caused by the accumulation of the toner is not occurred.

Moreover, the monomer or the oligomer is not remained in the toner particle since the polymerization reaction for forming the compound resin particle is completely performed. Consequently, any offensive odor is not occurred in the fixing process by heating in the image forming method using such the toner.

The surface property of thus produced toner particle is uniform and the charging amount distribution of the toner is sharp. Accordingly, an image with a high sharpness can be formed for a long period. The anti-offset and anti-winding properties can be improved and an image with suitable glossiness can be formed while a suitable adhesiveness or a high fixing strength with the recording material or recording paper or image support in the image forming method including a fixing process by contact heating by the use of such the toner which is uniform in the composition, molecular weight and the surface property of the each particles.

Each of the constituting materials used in the toner producing process is described in detail below.

(3) Polymerizable Monomer

A hydrophobic monomer is essentially used as the polymerizable monomer for producing the resin or binder used in the invention and a cross-linkable monomer is used according to necessity. As is described below, it is preferable to contain at least one kind of a monomer having an acidic polar group and a monomer having a basic polar group.

Hydrophobic Monomer

The hydrophobic monomer can be used, one or more kinds of which may be used for satisfying required properties.

Practically, employed may be aromatic vinyl monomers, acrylic acid ester based monomers, methacrylic acid ester based monomers, vinyl ester based monomers, vinyl ether based monomers, monoolefin based monomers, diolefin based monomers, halogenated olefin monomers, and the like.

Listed as aromatic vinyl monomers, for example, are styrene based monomers and derivatives thereof such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrne, p-n-nonylstyrene, p-n-decylstyrene, p-n-dodecylstyrene, 2,4-dimethylstyrne, 3,4-dichlorostyrene, and the like.

Listed as (meth)acrylic acid and its ester bases monomers are methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-aminoacrylate, stearyl methacrylate, dimethyl aminoethyl methacrylate, diethyl aminoethyl methacrylate, and the like.

Listed as vinyl ester based monomers are vinyl acetate, vinyl propionate, vinyl benzoate, and the like.

Listed as vinyl ether based monomers are vinyl methyl ether, vinyl ethyl ether, vinyl isobutyl ether, vinyl phenyl ether, and the like.

Listed as monoolefin based monomers are ethylene, propylene, isobutylene, 1-butene, 1-pentene, 4-methyl-1-pentene, and the like.

Listed as diolefin based monomers are butadiene, isoprene, chloroprene, and the like.

Listed as halogenated olefin based monomers are vinyl chloride, vinylidene chloride, vinyl bromide, and the like.

Crosslinking Monomers

In order to improve the desired properties of toner, added as crosslinking monomers may be radical polymerizable crosslinking monomers. Listed as radical polymerizable agents are those having at least two unsaturated bonds such as divinylbenzene, divinylnaphthalene, divinyl ether, diethylene glycol methacrylate, ethylene glycol dimethacrylate, polyethylene glycol dimethacrylate, phthalic acid diallyl, and the like.

Monomer Having an Acidic Polar Group

As the monomer having an acidic polar group, (a) an α,β-ethylenically unsaturated compound containing a carboxylic acid group (—COOH) and (b) an α,β-ethylenically unsaturated compound containing a sulfonic acid group (—$SO_3H$) can be cited.

Examples of said α,β-ethylenically unsaturated compound containing the carboxylic acid group (—COOH) of (a) include acrylic acid, methacrylic acid, fumaric acid, maleic acid, itaconic acid, cinnamic acid, maleic acid mono-butyl ester, maleic acid mono-octyl ester and their sodium salts, zinc salts, etc.

Examples of said α,β-ethylenically unsaturated compound containing the sulfonic acid group (—$SO_3H$) of (b) include sulfonated styrene and its Na salt, allylsulfo succinic acid, allylsulfo succinic acid octyl ester and their sodium salts. Monomer having a basic polar group As the monomer having a basic polar group, can be cited (i) (meth)acrylic acid ester obtained by reacting (meth)acrylic acid with an aliphatic alcohol, which has 1 to 12 carbon atoms, preferably 2 to 8 carbon atoms, specifically preferably 2 carbon atoms, and which also has an amino group or a quaternary ammonium group, (ii) (meth)acrylic acid amide or (meth)acrylic acid amide having mono-alkyl group or di-alkyl group, having 1 to 18 carbon atoms, substituted on its N atom, (iii) vinyl compound substituted with a heterocyclic group having at least a nitrogen atom in said heterocyclic group, (iv) N,N-di-allyl-alkylamine or its quaternary salt. Of these, (meth)acrylic acid ester obtained by reacting (meth)acrylic acid with the aliphatic alcohol having the amino group or the quaternary ammonium group is preferred.

Examples of (meth)acrylic acid ester obtained by reacting (meth)acrylic acid with the aliphatic alcohol having the amino group or the quaternary ammonium group of (i) include dimethylaminoethylacrylate, dimethylaminoethylmethacrylate, diethylaminoethylacrylate, diethylaminoethylmethacrylate, quaternary ammonium salts of the above mentioned four compounds, 3-dimethylaminophenylacrylate and 2-hydroxy-3-methacryloxypropyl trimethylammonium salt, etc.

Examples of (meth)acrylic acid amide or (meth)acrylic acid amide having mono-alkyl group or di-alkyl group substituted on its N atom of (ii) include acrylamide, N-butylacrylamide, N,N-dibutylacrylamide, piperidylacrylamide, methacrylamide, N-butylmethacrylamide, N,N-dimethylacrylamide, N-octadecylacrylamide, etc.

Examples of vinyl compound substituted with a heterocyclic group having at least a nitrogen atom in said heterocyclic group of (iii) include vinylpyridine, vinylpyrrolidone, vinyl-N-methylpyridinium chloride, vinyl-N-ethylpyridinium chloride, etc.

Examples of N,N-di-allyl-alkylamine or its quaternary salt of (iv) include N,N-di-allyl-methylammonium chloride, N,N-di-allyl-ethylammonium chloride, etc.

Polymerization Initiators

Radical polymerization initiators may be suitably employed in the present invention, as long as they are water-soluble. For example, listed are persulfate salts (potassium persulfate, ammonium persulfate, and the like), azo based compounds (4,4'-azobis-4-cyanovaleric acid and salts thereof, 2,2'-azobis(2-amidinopropane) salts, and the like), peroxides, and the like.

Further, if desired, it is possible to employ said radical polymerization initiators as redox based initiators by combining them with reducing agents. By employing said redox based initiators, it is possible to increase polymerization activity and decrease polymerization temperature so that a decrease in polymerization time is expected.

It is possible to select any polymerization temperature, as long as it is higher than the lowest radical formation temperature of said polymerization initiator. For example, the temperature range of 50 to 90° C. is employed. However, by employing a combination of polymerization initiators such as hydrogen peroxide-reducing agent (for example, ascorbic acid), which is capable of initiating the polymerization at room temperature, it is possible to carry out polymerization at room temperature or higher.

Chain Transfer Agents

For the purpose of regulating the molecular weight of resin particles, it is possible to employ commonly used chain transfer agents.

The chain transfer agents, for example, employed are mercaptans such as octylmercaptan, dodecylmercaptan, tert-dodecylmercaptan, and the like. The compound having mercaptan are preferably employed to give advantageous toner having such characteristics as reduced smell at the time of thermal fixing, sharp molecular weight distribution, good preservation ability, fixing strength, anti-off-set and so on. The actual compounds preferably employed include ethyl thioglycolate, propyl thioglycolate,-butyl thioglycolate, t-butyl thioglycolate, ethylhexyl thioglycolate, octyl thioglycolate, decyl thioglycolate, dodecyl thioglycolate, an ethyleneglycol compound having mercapto group, a neopentyl glycol compound having mercapto group, and a pentaerythritol compound having mercapto group. Among them n-octyl-3-mercaptopropionic acid ester is preferable in view of minimizing smell at the time of thermal fixing.

Surface Active Agents

In order to perform polymerization employing the aforementioned radical polymerizable monomers, it is required to conduct oil droplet dispersion in a water based medium employing surface active agents. Surface active agents, which are employed for said dispersion, are not particularly limited, and it is possible to cite ionic surface active agents described below as suitable ones.

Listed as ionic surface active agents are sulfonic acid salts (sodium dodecylbenzenesulfonate, sodium aryl alkyl polyethersulfonate, sodium 3,3-disulfondiphenylurea-4,4-diazo-bis-amino-8-naphthol-6-sulfonate, sodium ortho-caroxybenzene-azo-dimethylaniline-2,2,5,5-tetramethyl-triphenylmethane-4,4-diazi-bis-(-naphthol-6-sulfonate, and the like), sulfuric acid ester salts (sodium dodecylsulfonate, sodium tetradecylsulfonate, sodium pentadecylsulfonate, sodium octylsulfonate, and the like), fatty acid salts (sodium oleate, sodium laureate, sodium caprate, sodium caprylate, sodium caproate, potassium stearate, calcium oleate, and the like).

Further, it is possible to employ nonionic surface active agents. Specifically, it is possible to cite polyethylene oxide, polypropylene oxide, a combination of polypropylene oxide and polyethylene oxide, alkylphenol polyethylene oxide, esters of polyethylene glycol with higher fatty acids, esters of polypropylene oxide with higher fatty acids, sorbitan esters, and the like.

The resin particles preferably comprises "a high molecular weight resin" having a peak or a shoulder within the range of from 100,000 to 1,000,000, and "a low molecular weight resin" having a peak or a shoulder within the range of from 1,000 to 50,000, and more preferably "a middle molecular weight resin" having a peak or a shoulder within the range of from 15,000 to 100,000, in the molecular weight distribution.

Molecular weight of the resin composing toner is preferably measured by gel permeation chromatography (GPC) employing tetrahydrofuran (THF).

Added to 1 cc of THF is a measured sample in an amount of 0.5 to 5.0 mg (specifically, 1 mg), and is sufficiently dissolved at room temperature while stirring employing a magnetic stirrer and the like. Subsequently, after filtering the resulting solution employing a membrane filter having a pore size of 0.48 to 0.50 μm, the filtrate is injected in a GPC.

Measurement conditions of GPC are described below. A column is stabilized at 40° C, and THF is flowed at a rate of 1 cc per minute. Then measurement is carried out by injecting approximately 100 μl of said sample at a concentration of 1 mg/cc.

It is preferable that commercially available polystyrene gel columns are combined and used. For example, it is possible to cite combinations of Shodex GPC KF-801, 802, 803, 804, 805, 806, and 807, produced by Showa Denko Co., combinations of TSKgel G1000H, G2000H, G3000H, G4000H, G5000H, G6000H, G7000H, TSK guard column, and the like. Further, as a detector, a refractive index detector (IR detector) or a UV detector is preferably employed. When the molecular weight of samples is measured, the molecular weight distribution of said sample is calculated employing a calibration curve which is prepared employing monodispersed polystyrene as standard particles. Approximately ten polystyrenes samples are preferably employed for determining said calibration curve.

(Coagulants)

The coagulants selected from metallic salts are preferably employed in the processes of salting-out, coagulation and fusion from the dispersion of resin particles prepared in t e aqueous medium.

Listed as metallic salts, are salts of monovalent alkali metals such as, for example, sodium, potassium, lithium, etc.; salts of divalent alkali earth metals such as, for example, calcium, magnesium, etc.; salts of divalent metals such as manganese, copper, etc.; and salts of trivalent metals such as iron, aluminum, etc.

Some specific examples of these salts are described below. Listed as specific examples of monovalent metal salts, are sodium chloride, potassium chloride, lithium chloride; while listed as divalent metal salts are calcium chloride, zinc chloride, copper sulfate, magnesium sulfate, manganese sulfate, etc., and listed as trivalent metal salts, are aluminum chloride, ferric chloride, etc. Any of these are suitably selected in accordance with the application, and the two or three valent metal salt is preferable because of low critical coagulation concentration (coagulation point).

The critical coagulation concentration is an index of the stability of dispersed materials in an aqueous dispersion, and shows the concentration at which coagulation is initiated. This critical coagulation concentration varies greatly depending on the fine polymer particles as well as dispersing agents, for example, as described in Seizo Okamura, et al, Kobunshi Kagaku (Polymer Chemistry), Vol. 17, page 601 (1960), etc., and the value can be obtained with reference to the above-mentioned publications. Further, as another method, the critical coagulation concentration may be obtained as described below. An appropriate salt is added to a particle dispersion while changing the salt concentration to measure the ζ potential of the dispersion, and in addition the critical coagulation concentration may be obtained as the salt concentration which initiates a variation in the ζ potential.

The polymer particles dispersion liquid is processed by employing metal salt so as to have concentration not less than critical coagulation concentration. In this instance the metal salt is added directly or in a form of aqueous solution optionally, which is determined according to the purpose. In case that it is added in an aqueous solution the metal salt must satisfy the critical coagulation concentration including the water as the solvent of the metal salt.

The concentration of coagulant may be not less than the critical coagulation concentration. However, the amount of the added coagulant is preferably at least 1.2 times of the critical coagulation concentration, and more preferably 1.5 times.

Colorants

The toner is obtained by salting out/fusing the composite resin particles and colored particles.

Listed as colorants which constitute the toner of the present invention may be inorganic pigments, organic pigments, and dyes.

Employed as said inorganic pigments may be those conventionally known in the art. Specific inorganic pigments are listed below.

Employed as black pigments are, for example, carbon black such as furnace black, channel black, acetylene black, thermal black, lamp black, and the like, and in addition, magnetic powders such as magnetite, ferrite, and the like.

If desired, these inorganic pigments may be employed individually or in combination of a plurality of these. Further, the added amount of said pigments is commonly between 2 and 20 percent by weight with respect to the polymer, and is preferably between 3 and 15 percent by weight.

The magnetite can be incorporated when the toner is employed as a magnetic toner. In this instance from 20 to 60 weight percent of the magnetite is incorporated in view of sufficient magnetic characteristics.

Various organic pigments and dyes may be employed. Specific organic pigments as well as dyes are exemplified below.

The organic pigment or organic dye is also employed, examples thereof are listed.

Listed as pigments for magenta or red are C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 222, and the like.

Listed as pigments for orange or yellow are C.I. Pigment Orange 31, C.I. Pigment Orange 43, C.I. Pigment Yellow 12, C.I. Pigment Yellow 13, C.I. Pigment Yellow 14, C.I. Pigment yellow 15, C.I. Pigment Yellow 17, C.I. Pigment Yellow 93, C.I. Pigment Yellow 94, C.I. Pigment Yellow 138, C.I. Pigment Yellow 155, C.I. Pigment Yellow 156, C.I. Pigment yellow 180, C.I. Pigment Yellow 185, Pigment Yellow 155, Pigment Yellow 186, and the like.

Listed as pigments for green or cyan are C.I. Pigment Blue 15, C.I. Pigment Blue 15:2, C.I. Pigment Blue 15:3, C.I. Pigment Blue 16, C.I. Pigment Blue 60, C.I. Pigment Green 7, and the like.

Employed as dyes may be C.I. Solvent Red 1, 59, 52, 58, 63, 111, 122; C.I. Solvent Yellow 19, 44, 77, 79, 81, 82, 93, 98, 103, 104, 112, 162; C.I. Solvent Blue 25, 36, 60, 70, 93, and 95; and the like. Further these may be employed in combination.

If desired, these organic pigments, as well as dyes, may be employed individually or in combination of selected ones. Further, the added amount of pigments is commonly between 2 and 20 percent by weight, and is preferably between 3 and 15 percent by weight.

The colorants may also be employed while subjected to surface modification. Examples of the surface modifying agents include silane coupling agents, titanium coupling agents, aluminum coupling agents, and the like.

Examples of the silane coupling agent include alkoxysilane such as methyltrimethoxysilane, phenyltrimethoxysilane, methylphenyldimethoxysilane and diphenyldimethoxysilane; siloxane such as hexamethyldisiloxane, γ-chloropropyltrimethoxysilane, vinyltrichlorosilane, vinyltrimethoxysilane, vinyltriethoxysilane, γ-methacryloxypropyltrimethoxysilane, γ-glycidoxypropyltrimethoxysilane, γ-mercaptopropyltrimethoxysilane, γ-aminopropyltriethoxysilane, and γ-ureidopropyltriethoxysilane.

Examples of the titanium coupling agent include those marketed with brand "Plainact" TTS, 9S, 38S, 41B, 46B, 55, 138S, 238S etc., by Ajinomoto Corporation, A-1, B-1, TOT, TST, TAA, TAT, TLA, TOG, TBSTA, A-10, TBT, B-2, B-4, B-7, B-10, TBSTA-400, TTS, TOA-30, TSDMA, TTAB, TTOP etc., marketed by Nihon Soda Co., Ltd.

Examples of the aluminum coupling agent include "Plainact AL-M".

These surface modifiers is added preferably in amount of 0.01 to 20% by weight, and more preferably 0.5 to 5% by weight with reference to the colorant.

Surface of the colorant may be modified in such way that the surface modifier is added to the dispersion of colorant, then the dispersion is heated to conduct reaction.

Colorant having subjected to the surface modification is separated by filtration and dried after repeating rinsing and filtering with the same solvent.

Releasing Agents

Toner employed in the invention is preferably prepared by fusing resin particles containing a releasing agent and colored particles in water based medium and then digesting the obtained particles whereby the releasing agent and the colorant are dispersed in resin matrix adequately to form a domain-matrix structure. The digestion is a process subjecting the fused particles to continuing agitation at a temperature of melting point of the releasing agent plus minus 20 centigrade.

Preferable examples of the releasing agent include low molecular weight polypropylene and low molecular weight polyethylene each having average molecular weight of 1,500 to 9,000, and a particularly preferable example is an ester compounds represented by General Formula (1), described below.

$$R^1—(OCO—R^2)_n \quad (1)$$

wherein n represents an integer of 1 to 4, and preferably 2 to 4, more preferably 3 or 4, and in particular preferably 4, $R^1$ and $R^2$ each represent a hydrocarbon group which may have a substituent respectively. $R^1$ has from 1 to 40 carbon atoms, and preferably 1 to 20, more preferably 2 to 5. $R^2$ has from 1 to 40 carbon atoms, and preferably 16 to 30, more preferably 18 to 26.

The representative examples are listed.

1) $CH_3—(CH_2)_{12}—COO—(CH_2)_{17}—CH_3$

2) $CH_3—(CH_2)_{18}—COO—(CH_2)_{17}—CH_3$

3) $CH_3—(CH_2)_{20}—COO—(CH_2)_{21}—CH_3$

4) $CH_3—(CH_2)_{14}—COO—(CH_2)_{19}—CH_3$

5) $CH_3—(CH_2)_{20}—COO—(CH_2)_6—O—CO—(CH_2)_{20}—CH_3$

6) $CH_3—(CH_2)_{20}—COO—(CH_2)_2—CH(CH_3)—CH_2—O—CO—(CH_2)_{20}—CH_3$

7) $CH_3—(CH_2)_{22}—COO—(CH_2)_2—CH(CH_3)—CH_2—O—CO—(CH_2)_{22}—CH_3$

8) $CH_3—(CH_2)_{22}—COO—CH_2—C(CH_3)_2—CH_2—O—CO—(CH_2)_{22}—CH_3$

9) $CH_3—(CH_2)_{26}—COO—CH_2—C(CH_3)_2—CH_2—O—CO—(CH_2)_{26}—CH_3$

10) $CH_2—O—CO—(CH_2)_{26}—CH_3$
$CH—O—CO—(CH_2)_{26}—CH_3$
$CH_2—O—CO—(CH_2)_{26}—CH_3$

11) $CH_2—O—CO—(CH_2)_{22}—CH_3$
$CH—O—CO—(CH_2)_{22}—CH_3$
$CH_2—O—CO—(CH_2)_{22}—CH_3$

-continued

12) $CH_2—OH$
$CH—O—CO—(CH_2)_{26}—CH_3$
$CH_2—O—CO—(CH_2)_{26}—CH_3$

13) $CH_2—OH$
$CH—O—CO—(CH_2)_{22}—CH_3$
$CH_2—O—CO—(CH_2)_{22}—CH_3$

14) $CH_2—OH$
$CH—OH$
$CH_2—O—CO—(CH_2)_{26}—CH_3$

15) $CH_2—OH$
$CH—OH$
$CH_2—O—CO—(CH_2)_{22}—CH_3$

16) $CH_3—(CH_2)_{26}—COO—CH_2—C(CH_3)(CH_2—O—CO—(CH_2)_{26}—CH_3)_2$

17) $CH_3—(CH_2)_{20}—COO—CH_2—C(CH_2CH_3)(CH_2—O—CO—(CH_2)_{20}—CH_3)_2$

18) $CH_3—(CH_2)_{26}—COO—CH_2—C(CH_2—O—CO—(CH_2)_{26}—CH_3)_3$

19) $CH_3—(CH_2)_{20}—COO—CH_2—C(CH_2—O—CO—(CH_2)_{20}—CH_3)_3$

20) $CH_3—(CH_2)_{18}—COO—CH_2—C(CH_2—O—CO—(CH_2)_{18}—CH_3)_3$

21) $CH_3—(CH_2)_{16}—COO—CH_2—C(CH_2—O—CO—(CH_2)_{16}—CH_3)_3$

22) $CH_3—(CH_2)_{20}—COO—CH_2—C(CH_2—O—CO—CH_3)_3$

The releasing agent is added in an amount of between 2 and 20 percent by weight, and is preferably between 3 and 15 percent by weight.

The releasing agent is preferably incorporated in the toner particles by salting-out/fusing a colorant and resin particles involving the releasing agent prepared by mini-emulsion method.

Addition Process of External Additives

External additives are added to the dried toner particles. Examples of the additive include metal salt of aliphatic acid, external abrasive, usual additives such as silica fine powder. Examples of the preparation apparatus include Henschel mixer, Nauter mixer.

As for the toner according to the invention external additives are reside on a surface of the particles uniformly, and sharp charging distribution and high fluidity can be obtained. Consequently the toner is excellent in developing characteristics and fine line reproduction characteristics, and can give stabilized cleaning characteristics for long term.

As result of study in view of minute shape of each toner particles, it has been found that corner part of the toner particles becomes round and the part accelerates the embedding external additives and deteriorates charging quantity variation, fluidity and cleaning characteristics. The charging quantity of the toner particles becomes non-uniform since the external additives are embedded at the corner part when the charge is imparted to the toner by triboelectricity. The invention can prevent the deterioration effectively.

Toner particles preferably has a variation coefficient of shape coefficient of not more than 16%, and a shape coefficient of from 1.2 to 1.6 in a ratio of not less than 65%.

The toner used in the present invention preferably has a number ratio of toner particles having no corners of 50 percent or more, a number variation coefficient in the toner number size distribution of not more than 27 percent, and a number ratio of toner particles having a shape coefficient of 1.2 to 1.6 being at least 65 percent.

A number ratio of toner particles having a shape coefficient of 1.2 to 1.6 is preferably at least 65 percent, and a variation coefficient of the shape coefficient is preferably not more than 16 percent.

In a number based histogram, in which natural logarithm lnE is taken as the abscissa and said abscissa is divided into a plurality of classes at an interval of 0.23, a toner is preferred, which exhibits at least 70 percent of the sum (M) of the relative frequency ($m_1$) of toner particles included in the highest frequency class, and the relative frequency ($m_2$) of toner particles included in the second highest frequency class. E is diameter of toner particles (in μm).

By adjusting the sum (M) of the relative frequency ($m_1$) and the relative frequency ($m_2$) to at least 70 percent, the dispersion of the resultant toner particle size distribution narrows. Thus, by employing said toner in an image forming process, it is possible to securely minimize the generation of selective development.

The histogram, which shows said number based particle size distribution, is one in which natural logarithm lnE (wherein E represents the diameter of each toner particle) is divided into a plurality of classes at an interval of 0.23 (0 to 0.23, 0.23 to 0.46, 0.46 to 0.69, 0.69 to 0.92, 0.92 to 1.15, 1.15 to 1.38, 1.38 to 1.61, 1.61 to 1.84, 1.84 to 2.07, 2.07 to 2.30, 2.30 to 2.53, 2.53 to 2.76 . . . ). Said histogram is drawn by a particle size distribution analyzing program in a computer through transferring to said computer via the I/O unit particle diameter data of a sample which are measured employing a Coulter Multisizer under the conditions described below.

(Measurement Conditions)

(1) Aperture: 100 μm (2) Method for preparing samples: an appropriate amount of a surface active agent (a neutral detergent) is added while stirring in 50 to 100 ml of an electrolyte, Isoton R-11 (manufactured by Coulter Scientific Japan Co.) and 10 to 20 ml of a sample to be measured is added to the resultant mixture. Preparation is then carried out by dispersing the resultant mixture for one minute employing an ultrasonic homogenizer.

The shape coefficient, variation coefficient of the shape coefficient, distribution of particle number, number variation coefficient and number ratio of particles having no corner will be detailed.

Shape coefficient of toner is a shape coefficient of toner particles, showing roundness of toner particles, which is defined as follows.

$$\text{Shape coefficient}=[(\text{maximum diameter}/2)^2\times\pi]/\text{projection area}$$

wherein the maximum diameter means the maximum width of a toner particle obtained by forming two parallel lines between the projection images of said particle on a plane, while the projection area means the area of the projected image of said toner on a plane.

In the present invention, said shape coefficient was determined in such a manner that toner particles were photographed under a magnification factor of 2,000, employing a scanning type electron microscope, and the resultant photographs were analyzed employing "Scanning Image Analyzer", manufactured by JEOL Ltd. At that time, 100 toner particles were employed and the shape coefficient of the present invention was obtained employing the aforementioned calculation formula.

The polymerized toner of the present invention is that the number ratio of toner particles in the range of said shape coefficient of 1.2 to 1.6 is preferably at least 65 percent and is more preferably at least 70 percent.

The variation coefficient of the polymerized toner is calculated using the formula described below:

$$\text{Variation coefficient}=(S/K)\times 100 \text{ (in percent)}$$

wherein S represents the standard deviation of the shape coefficient of 100 toner particles and K represents the average of said shape coefficient.

Said variation coefficient of the shape coefficient is generally not more than 16 percent, and is preferably not more than 14 percent.

The number particle distribution as well as the number variation coefficient of the toner of the present invention is measured employing a Coulter Counter TA-11 or a Coulter Multisizer (both manufactured by Coulter Co.). In the present invention, employed was the Coulter Multisizer which was connected to an interface which outputs the particle size distribution (manufactured by Nikkaki), as well as on a personal computer. Employed as used in said Multisizer was one of a 100 μm aperture. The volume and the number of particles having a diameter of at least 2 μm were measured and the size distribution as well as the average particle diameter was calculated. The number particle distribution, as described herein, represents the relative frequency of toner particles with respect to the particle diameter, and the number average particle diameter as described herein expresses the median diameter in the number particle size distribution.

The number variation coefficient in the number particle distribution of toner is calculated employing the formula described below:

$$\text{Number variation coefficient}=(S/D_n)\times 100 \text{ (in percent)}$$

wherein S represents the standard deviation in the number particle size distribution and $D_n$ represents the number average particle diameter (in μm).

The number variation coefficient of the toner of the present invention is not more than 27 percent, and is preferably not more than 25 percent.

A number ratio of toner particles having no corners is 50 percent or more, and preferably 70 percent of more.

The toner particles which substantially have no corners, as described herein, mean those having no projection to which charges are concentrated or which tend to be worn down by stress.

Namely, the main axis of toner particle is designated as L. Circle C having a radius of L/10, which is positioned in toner, is rolled along the periphery of toner, while remaining in contact with the circumference at any point. When it is possible to roll any part of said circle without substantially crossing over the circumference of toner, a toner is designated as "a toner having no corners". "Without substantially crossing over the circumference" as described herein means that there is at most one projection at which any part of the rolled circle crosses over the circumference. Further, "the main axis of a toner particle" as described herein means the maximum width of said toner particle when the projection image of said toner particle onto a flat plane is placed between two parallel lines.

Toner having no corners is measured as follows. First, an image of a magnified toner particle is made employing a scanning type electron microscope. The resultant picture of the toner particle is further magnified to obtain a photographic image at a magnification factor of 15,000. Subsequently, employing the resultant photographic image, the presence and absence of said corners is determined. Said measurement is carried out for 100 toner particles.

Developer and Developing Method

The toner of the present invention may be employed in either a single-component developer or a two-component developer.

Listed as single-component developers are a non-magnetic single-component developer, and a magnetic single-component developer in which magnetic particles having a diameter of 0.1 to 0.5 μm are incorporated into a toner. The toner may be employed in both developers.

Further, said toner is blended with a carrier and employed as a two-component developer. In this case, employed as magnetic particles of the carrier may be conventional materials known in the art, such as metals such as iron, ferrite, magnetite, and the like, alloys of said metals with aluminum, lead and the like. Specifically, ferrite particles are preferred. The volume average particle diameter of said magnetic particles is preferably 15 to 100 μm, and is more preferably 25 to 80 μm.

The volume average particle diameter of said carrier can be generally determined employing a laser diffraction type particle diameter distribution measurement apparatus "Helos", produced by Sympatec Co., which is provided with a wet type homogenizer.

The preferred carrier is one in which magnetic particles are further coated with resins, or a so-called resin dispersion type carrier in which magnetic particles are dispersed into resins. Resin compositions for coating are not particularly limited. For example, employed are olefin based resins, styrene based resins, styrene-acryl based resins, silicone based resins, ester based resins, or fluorine containing polymer based resins. Further, resins, which constitute said resin dispersion type carrier, are not particularly limited. For example, listed may be styrene-acryl based resins polyester resins, fluorine based resins, phenol resins, and the like.

Employed as development methods may be either a contact method or a non-contact method. When the non-contact development method is employed, it is possible to carry out normal development under non-contact as well as reversal development under non-contact. In such a case, a direct current development electric field is commonly from $1\times10^3$ to $1\times10^5$ V/cm in terms of the absolute value, and is preferably from $5\times10^3$ to $1\times10^4$ V/cm.

AC bias is 0.5 to 4 kV p-p, preferably 1 to 3 kV p-p, and frequency is 0.1 to 10 kHz, preferably 2 to 8 kHz.

Preferable bias voltage and frequency are determined so as to give sufficient development characteristics.

Image Forming Method and Image Forming Apparatus

An image forming method and an image forming apparatus are described.

Figure 12:
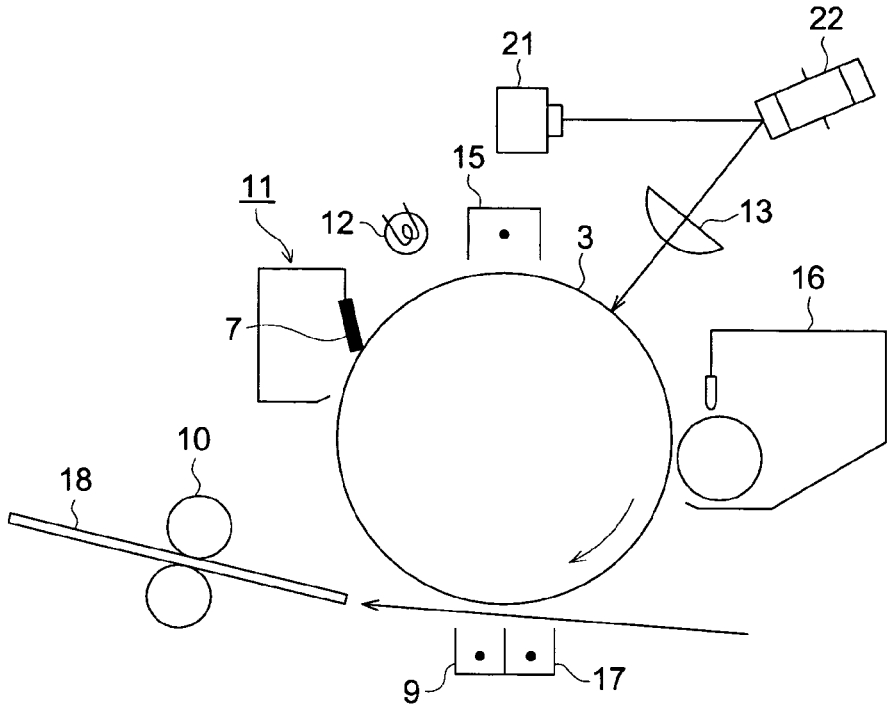
FIG. 12 is a view showing a structure of one example of an image forming apparatus to which a charging roller is applied.

FIG. 12 is a cross-sectional view showing the structure of an example of another image forming apparatus employed in the image forming method of the present invention.

In FIG. 16, numeral 3 is the photoreceptor drum which is an image forming body which is prepared by forming organic photoconductors as a photosensitive layer on the circumferential surface of an aluminum drum substrate, and rotates in the arrowed direction at the specified rate.

In FIG. 12, based on information read by an original document reading apparatus (not shown), an exposure beam is emitted from semiconductor laser beam source 21. The resulting beam is allotted to the vertical direction with respect to the sheet surface on which FIG. 12 is drawn, employing polygonal mirror 22 and irradiated on the photoreceptor surface via fθ lens 13 which compensates image distortion, whereby electrostatic latent images are formed. Photoreceptors drum 3 which is an image forming body is previously and uniformly charged employing charging unit 15 and starts rotation in the clockwise direction while matching image exposure timing.

An electrostatic latent image on the photoreceptor surface is developed by development unit 16 and the developed image is transferred onto transfer paper 18, which has been transported while matching timing, utilizing action of transfer unit 17. Further transfer paper 18 is separated from photoreceptor drum 3, employing separation unit 9 (a separation pole), while the toner image is transfer-held on transfer paper 18, transported to fixing unit 10, and fixed.

The non-transferred toner which remains on the photoreceptor surface is removed by cleaning blade 12 of cleaning unit 11 and residual charge is eliminated by pre-charging exposure (PCL) 12. Subsequently, the photoreceptor is again uniformly charged by charging unit 15 for the subsequent image formation.

Toner Recycling System

Systems for recycling toner are not particularly limited. Listed as one of systems may be, for example, a method in which toner recovered in the cleaning section is transported to the hopper for supplying toner or the development unit, employing a transport conveyer or a transport screw, or is supplied to the development unit after being mixed with supply toner in an intermediate chamber. Preferably listed as systems may be a system in which the recovered toner is directly returned to the development unit or supply toner and recovered toner are mixed in the intermediate chamber and the resulting mixture is supplied to the development unit.

Figure 13:
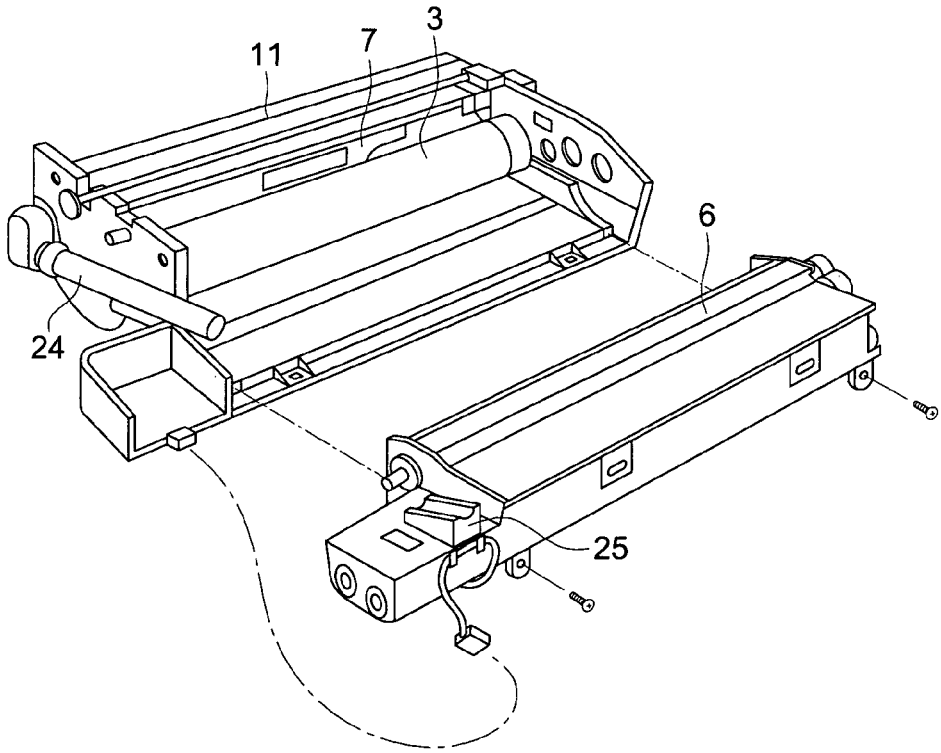
FIG. 13 is a view showing an example of a toner recycle device.

FIG. 13 is a perspective view showing the member structure of one example of a toner recycling apparatus.

In this system, recovered toner is directly returned to the development unit. The non-transferred toner, which is recovered by cleaning blade 7, is collected in toner recycling pipe 24, employing the transport screw in cleaning unit 11, is returned to development unit 16 from exit 425 of the recycling pipe, and is reused as a developer.

FIG. 13 is also a perspective view of a processing cartridge which is removably attached to the image forming apparatus according to the present invention. In FIG. 13, in order to make the perspective view more understandable, the photoreceptor unit and the developer unit are separated. In practice, these are integrated to a single unit which may be removably installed in the image forming apparatus. In this case, the photoreceptor drum, the development unit, the cleaning unit, and the recycling member are integrated so as to constitute a processing cartridge.

The image forming apparatus may be structured so that a processing cartridge, which comprises at least one of the charging unit, the development unit, the cleaning unit, or the recycling member together with the photoreceptor drum, is installed.

Representative transfer materials (transfer paper) include plain paper. However, transfer materials are not particularly limited, as long as unfixed images after development are transferable, and include PET bases for overhead projectors or OHP.

As noticed above, employed as cleanings blade 7 is a rubber elastic body having a thickness of about 1 to about 30 mm, and frequently employed as materials is urethane rubber. Since the cleaning blade is employed under pressure contact with the photoreceptor, it is easily affected by heat. Therefore, in the present invention, it is preferable that the cleaning blade is separated from the photoreceptor during no image forming operation while proving a withdrawing mechanism.

It is possible to apply the present invention to image forming apparatuses utilizing an electrophotographic method, particularly to apparatuses in which electrostatic latent images are formed on the photoreceptor, employing a modulated beam which is modulated using digital image data from computers.

In recent years, in the field such as electro photography in which electrostatic latent images are formed on a photoreceptor drum and the resulting latent images are developed to form visible images, increasingly carried have been research and development of image forming methods, utilizing a digital system, in which improvements of image quality, conversion, and edition are easily achieved and it is possible to form high quality images.

There are an apparatus in which as a scanning optical system which is subjected to light modulation, employing digital image signals from a computer employed in the aforesaid image forming method and apparatus or copying original documents, an acoustic optical modulator is interposed in a laser optical system and light modulation is achieved by the aforesaid acoustic optical modulator, and an apparatus in which laser intensity is subjected to direct modulation employing semiconductor lasers. Spot exposure is carried out onto a uniformly charged photoreceptor from these scanning optical systems, and images comprised of dots are formed.

A beam emitted from the aforesaid scanning optical system results in a circular or elliptical luminance distribution analogous to the normal distribution with longer extent on both sides. For example, in the case of laser beams, the resulting distribution in either the primary scanning direction or the secondary scanning direction, or both is circular or elliptical, which has an extremely narrow width such as 20 to 100 μm.

(5) Cleaning Means and Other Structures

It is preferable that cleaning is carried out employing a blade cleaning system which employs elastic rubber blades as a member. Employed as elastic rubber may be urethane rubber and silicone rubber. Of these, urethane rubber is particularly preferred.

When image forming apparatuses are employed as copiers and printers, image exposure is performed as follows. A photoreceptor is exposed to light reflected from or transmitted through an original document. Alternatively, an original document is read employing a sensor and the resulting reading is converted to signals. Based on the signals, a laser beam is scanned, an LED array is driven, or a liquid crystal array is driven. By so doing, a photoreceptor is exposed imagewise to light.

When employed as printers of facsimile machines, image exposure unit 13 performs exposure to print receiving data.

It is possible to apply the image forming apparatus of the present invention to general electrophotographic apparatuses such as copiers, laser printers, LED printers, and liquid crystal shutter type printers. It is also possible to apply the same widely to displays, recording, short run printing, plate making, and facsimiles to which electrophotographic techniques are applied.

EXAMPLES

The examples of the present invention will now be described.

Example 1

Preparation of Photoreceptor 1

A semi-conductive layer, having a dried layer thickness of 15 μm, was formed by applying the coating composition prepared as described below onto a cylindrical drawn aluminum substrate having a drum diameter of 30 mm.

| <Coating Composition of Semi-Conductive Layer (PCL)> | |
|---|---|
| Phenol resin | 160 g |
| Conductive titanium oxide | 200 g |
| Methyl cellosolve | 100 ml |

Subsequently, the interlayer coating composition described below was prepared. The resulting coating composition was applied onto the aforesaid conductive layer, employing a dip coating method, and a 1.0 m thick interlayer was formed.

| <Coating Composition of Inter Layer (UCL)> | |
|---|---|
| Polyamide resin (Amilan CM-8000, manufactured by Toray Industries Inc.) | 60 g |
| Methanol | 1600 ml |
| 1-Butanol | 400 ml |

Further, the composition prepared as described below was dispersed for 10 hours employing a sand mill, whereby a charge generating layer coating composition was prepared.

The resulting composition was applied onto the aforesaid interlayer, employing a dip coating method, whereby a 0.2 μm thick charge generating layer was formed.

| <Charge Generating Layer (CGL) Composition> | |
|---|---|
| Y type titanyl phthalocyanine | 60 g |
| Silicone resin solution (KR5240, 15 percent xylene-butanol solution, manufactured by Shin-Etsu Kagaku Co.) | 700 g |
| 2-Butanone | 2000 ml |

Finally, the components described below were mixed and dissolved, whereby a charge transport layer coating composition was prepared. The resulting composition was applied onto the aforesaid charge generating layer, employing a dip coating method, whereby a 20 μm thick charge transport layer was prepared. Thus, Photoreceptor 1 was prepared.

| <Charge Transport Layer (CTL) Coating Composition> | |
|---|---|
| Charge transport material | 200 g |
| Bisphenol Z type polycarbonate (Iupilon Z300, manufactured by Mitsubishi Gas Kagaku Co.) | 300 g |
| 1,2-Dichloroethane | 2000 ml |

Preparation of Photoreceptor 2

The interlayer coating composition described below was applied onto a aluminum substrate, having a drum diameter of 30 mm and subsequently dried at 150° C. for 30 minutes, whereby a 1.0 μm thick interlayer was formed.

| <Interlayer (UCL) Coating Composition> | |
|---|---|
| Zirconium chelate compound ZC-540 (manufactured by Matsumoto Seiyaku Co.) | 200 g |
| Silane coupling agent KBM-903 (manufactured by Shin-Etsu Kagaku Co.) | 100 g |
| Methanol | 700 ml |
| Ethanol | 300 ml |

Subsequently, the components described below were mixed, and the resulting mixture was dispersed for 10 hours, employing a sand mill, whereby a charge generating layer coating composition was prepared. The resulting coating composition was applied onto the aforesaid interlayer, employing a dip coating method, whereby a 0.2 μm thick charge generating layer was formed.

| <Charge Generating Layer (CGL) Coating Composition> | |
|---|---|
| Y type titanyl phthalocyanine | 60 g |
| Silicone resin solution (KR5240, 15 percent xylene-butanol solution, manufactured by Shin-Etsu Chemical Co., Ltd.) | 700 g |
| 2-Butanone | 2000 ml |

Further, the charge transport layer coating composition described below was prepared. The resulting coating composition was applied onto the aforesaid charge generating layer, whereby a 20 μm thick charge transport layer was formed. Thus, Photoreceptor 2 was prepared.

| <Charge Transport Layer (CTL) Coating Composition> | |
|---|---|
| Charge transport material | 200 g |
| Bisphenol Z type polycarbonate (Iupilon Z300, manufactured by Mitsubishi Gas Chemical Company Inc.) | 300 g |
| 1,2-Dichloroethane | 2000 ml |

Preparation of Photoreceptor 3

A protective layer coating composition was prepared by mixing and dissolving the components described below, and was applied onto the charge transport layer of Photoreceptor 2.

<Protective Layer (OCL) Coating Composition>

Added to 10 parts by weight of a polysiloxane resin comprised of 80 mol percent of methylsiloxane units and 20 mol percent of methyl-phenylsiloxane units was molecular sieve 4A. The resulting mixture was allowed to stand for 15 hours and was subjected to dehydration. The resulting resin was dissolved in 10 parts by weight of toluene and was added with 5 parts by weight of methyltrimethoxysilane and 0.2 parts by weight of dibutyl tin acetate so as to form a solution. Added to the resulting solution were 6 parts by weight of dihydroxymethyltriphenylamine and dissolved. The resulting solution was coated to form a protective layer having a dried layer thickness of 2 μm, which was then subjected to thermal curing at 120° C. for one hour. Thus Photoreceptor 3 was prepared.

Preparation of Photoreceptor 4

An interlayer having a dried layer thickness of 2 μm was formed by applying the interlayer coating composition described below onto an aluminum substrate having a drum diameter of 30 mm, employing a dip coating method.

<Interlayer (UCL) Coating Composition>

The interlayer dispersion, described below, was diluted by a factor of two employing the same solvent mixture. After allowing to stand overnight, the resulting dispersion was filtered (employing Rigimesh Filter, manufactured by Nihon Pall Ltd., having a nominal filtration accuracy of 5 micron under a pressure of 5N/cm$^2$), whereby an interlayer coating composition was prepared.

| (Preparation of Interlayer Dispersion) | |
|---|---|
| Polyamide resin CM8000 (manufactured by Toray Co.) | 1.0 part by weight |
| Titanium oxide SMT500SAS (manufactured by TAYCA Corp., being subjected to a surface treatment consisting of a silica treatment, an alumina treatment, and a methylhydrogenpolysiloxane treatment) | 3.0 parts by weight |
| Methanol | 10 parts by weight |

were dispersed for 10 hours employing a sand mill.

Subsequently, a charge generating layer coating composition was prepared by mixing the composition described below and dispersing the resulting mixture employing a sand mill. The resulting coating composition was applied onto the aforesaid interlayer, employing a dip coating method, whereby a charge generating layer having a dried layer thickness of 0.3 μm was formed.

| <Charge Generating Layer (CGL) Coating Composition> | |
|---|---|
| Y type oxytitanyl phthalocyanine (having 27.3 degrees of maximum peak angle of X-ray diffraction using CU-Kα characteristic X-ray in terms of 2θ) | 20 g |
| polyvinyl butyral (#6000-C, manufactured by Denki Kagaku Kogyo Co.) | 10 g |
| t-Butyl acetate | 700 g |
| 4-methoxy-4-methyl-2-pentanone | 300 g |

Further the composition described below was mixed and a charge transport layer coasting composition was prepared. The resulting composition was applied onto the aforesaid charge generating layer, employing a dip coating method, whereby a 24 μm thick charge transport layer was formed.

| <Charge Transport Layer (CTL) Coating Composition> | |
|---|---|
| Charge transport material | 75 g |
| Polycarbonate resin "Iupilon-Z300" (manufactured by Mitsubishi Gas Chemical Company Inc.) | 100 g |
| Dioxolan/toluene (mixing mol ratio of 10/1) | 750 g |

2. Removal Method of Coating Layer

A. <Use of Removal Tape>

Removal Method A-1

Wiping-off tape and a photoreceptor drum were installed in the coating layer removal apparatus shown in FIG. 7(*b*). The wiping tape impregnated with solvents was brought into contact with 10 mm wide coating layer from the edge of the photoreceptor drum which rotated at a rate of 5 to 30 rpm, while keeping an inclination angle of 1.0 degree.

Subsequently, under such a contact state, the wiping tape was allowed to move at a moving rate of 500 to 3,000 mm/minute in the opposite direction with respect to the rotation direction of the photoreceptor drum, until the coating layer was removed. Thus the coating layer was removed.

The wiping-off tape was brought into pressure contact with 15 percent of the circumference of the photoreceptor drum, employing two pressure rollers, while tension of 25 N/20 mm width was applied between the master roll and the winding roll.

Removal Method A-2

Removal was performed in the same manner as aforesaid Removal Method A-1 of the coating layer, except that the inclination angle was varied to 0.0 degree.

B. <Use of Brush>

Removal Method B-1

An electrophotographic photoreceptor was produced so as to form an approximately 1 cm non-coated portion in the upper edge and was transported to a coating layer removal process. Series of operations, as described for FIG. 8, was then performed and a 1 cm wide coating layer in the lower edge was removed. The resulting photoreceptor was transported to the subsequent drying process whereby a finished photoreceptor was prepared. Employed as solvents in the solvent tank of the coating layer removing apparatus was methylene chloride which was the same as the charge transport layer. A 0.5 mm polyester brush, employed as a rubbing member of the coating layer removing stand, rotated, and the residual solvent ratio in the edge of the coating layer at the start of the coating layer removal was set at 12.0 percent. (percent by weight, in which the solvent amount in the coating composition was 100 percent by weight).

Removal Method B-2

The same polyester brush as Removing Method B-1 was employed as a rubbing member. However, during removing the coating layer, the coating layer removing stand was dipped in the solvent tank as described in Example 1 of Japanese Patent Application Open to Public Inspection No. 5-142789 and the lower edge of the coating layer was peeled off.

The aforesaid four types of Photoreceptors 1 through 4 and Removal Methods A-1, A-2, B-1, and B-2 were combined as shown in Table 1, and peeling was carried out in each combination.

Table 1 shows the results.

TABLE 1

| Drum No. | Example | Removal Method | Used Solvent | Unevenness in Lateral Direction (mm) | P (μm) | Pmax-P (μm) | (Pmax/D) × 100 | Edge Removal State |
|---|---|---|---|---|---|---|---|---|
| 1 | 1 | A-1 | *1 | Less than 2 | 20 | 7 | 3 | Good |
| 2 | 2 | A-1 | *1 | Less than 2 | 15 | 8 | 20 | Good |
| 3 | 3 | A-1 | *1 | Less than 2 | 30 | 20 | 10 | Good |
| 4 | 4 | A-1 | *2 | Less than 2 | 25 | 21 | 5 | Good |
| 5 | 1 | B-1 | *1 | Less than 2 | 22 | 18 | 40 | Good |
| 6 | 2 | B-1 | *1 | Less than 2 | 16 | 0 | 10 | Good |
| 7 | 3 | B-1 | *1 | Less than 2 | 26 | 19 | 10 | Good |
| 8 | 4 | B-1 | *2 | Less than 2 | 20 | 3 | 3 | Good |
| 9 | 2 | A-2 | *2 | About 4 | 16 | 20 | 20 | *3 |
| 10 | 3 | A-2 | *2 | About 4 | 26 | 8 | 1 | *4 |
| 11 | 3 | B-2 | *2 | About 4 | 26 | 12 | 55 | *5 |

*1; methanol/methylene chloride = 1/1
*2; methanol/dioxolane = 1/1
*3; the edge tends to be removed due to large projection
*4; a thin layer portion in the edge is long, and the portion tends to be peeled off
*5; the cut edge is steep and tends to be peeled off

*Unevenness in the lateral direction: difference between the maximum value and the minimum value of indentation caused by removal in the circumferential direction when the drum is viewed from above 2. Toner and Developer

LATEX 1HML (1) Preparation of Core Particle (a First Stage Polymerization)

Placed into a 5,000 ml separable flask fitted with a stirring unit, a temperature sensor, a cooling pipe, and a nitrogen gas inlet was a surface active agent solution (water based medium) prepared by dissolving 7.08 g of an anionic surface active agent (sodium dodecylbenzenesulfonate: SDS) in 3,010 g of deionized water, and the interior temperature was raised to 80° C. under a nitrogen gas flow while stirring at 230 rpm.

Subsequently, a solution prepared by dissolving 9.2 g of a polymerization initiator (KPS) in 200 g of deionized water was added to the surface active agent solution and it was heated at 75° C., a monomer mixture solution consisting of 70.1 g of styrene, 19.9 g of n-butyl acrylate, and 10.9 g of methacrylic acid was added dropwise over 1 hour. The mixture underwent polymerization by stirring for 2 hours at 75° C. (a first stage polymerization). Thus latex (a dispersion comprised of higher molecular weight resin particles) was obtained. The resulting latex was designated as Latex (1H).

(2) Forming an Inter Layer

A monomer solution was prepared in such way that 72.0 g of Exemplified Compound 19) was added to monomer mixture solution consisting of 105.6 g of styrene, 30.0 g of n-butyl acrylate, 6.4 g of methacrylic acid, 5.6 g of n-octyl-3-mercaptopropionic acid ester and the mixture was heated to 80 °C. to dissolve the monomers in a flask equipped with a stirrer.

Surfactant solution containing 1.60 of anionic surfactant SDS dissolved in 1200 ml of deionized water was heated to 80° C. To the surfactant solution 28 g (converted in solid content) the latex 1H, dispersion of core particles, was added, then the monomer solution containing the Exemplified Compound 19) was mixed and dispersed by means of a mechanical dispersion machine, "CLEARMIX" (produced by M Technique Ltd.) equipped with circulating pass, and a dispersion (emulsion) containing dispersion particles (oil droplet) having homogeneous particle diameter (284 nm) was prepared.

Subsequently, initiator solution containing 5.0 g of polymerization initiator (KPS) dissolved in 240 ml of deionized water, and 750 ml of deionized water were added to the dispersion (emulsion). Polymerization was conducted by stirring with heating at 80° C. for 3 hours, as the result, latex (dispersion of composite resin particles which are composed of resin particles having higher molecular weight polymer resin covered with an intermediate molecular weight polymer) was obtained (a second stage polymerization). The resulting latex was designated as Latex (1HM).

(3) Forming Outer Layer (Third Stage Polymerization)

Polymerization initiator solution containing 7.4 g of polymerization initiator KPS dissolved in 200 ml deionized water was added to the latex 1HM, then monomer mixture solution consisting of 300 g of styrene, 95 g of n-butylacrylate, 15.3 g of methacrylic acid, and 10.4 g of n-octyl-3-mercaptoprpionic ester was added dropwise over 1 hour at temperature of 80° C.

The mixture underwent polymerization by stirring with heating for 2 hours (a third stage polymerization), it was cooled to 28° C. Thus Latex 1HML composed of core composed of higher molecular weight polymer resin, an inter layer composed of an intermediate molecular weight polymer resin and an outer layer composed of lower molecular weight polymer resin in which inter layer the Exemplified Compound 19) was incorporated was obtained.

The polymers composed of composite resin particles composing the latex 1HML have peaks at molecular weight of 138,000, 80,000 and 13,000, and weight average particular size of the composite resin particles was 122 nm.

(Preparation of Colored Particles 1 to 7)

Added to 1600 ml of deionized water were 59.0 g of polyoxyethylene lauryl ether sodium sulfite (the numbers of adducts of ethyleneoxide 3), which were stirred and dissolved. While stirring the resulting solution, 420.0 g of carbon black, "Regal 330" (produced by Cabot Corp.), were gradually added, and subsequently dispersed employing a stirring unit, "Clearmix" (produced by M Technique Ltd.).

Colorant Dispersion was Obtained

Placed into a four-necked flask fitted with a temperature sensor, a cooling pipe, a nitrogen gas inlet unit, and a stirring unit having two baffles with angle of 25 degree were 420.7 g (converted in solid content) of Latex (1HML), 900 g of deionized water, and 166 g of Colorant Dispersion, and the resulting mixture was stirred. After adjusting the interior temperature to 30° C., 5 mol/1 L aqueous sodium hydroxide solution was added to the resulting solution, and the pH was adjusted to 11.0.

The particle size of the dispersed particle was measured using an electrophoretic particle distribution measurement apparatus ELS-800 (manufactured by Ootsuka Denshi Co., Ltd.). The volume average particle size obtained was 112 nm.

Subsequently, an aqueous solution prepared by dissolving 12.1 g of magnesium chloride tetrahydrate in 1000 ml of deionized water was added at 30° C. over 6 minutes. After setting the resulting mixture aside for 3 minutes, it was heated so that the temperature was increased to 90±3° C. within 6 to 10 minutes depending on Colored Particle samples (at a temperature increase rate of 10° C./minute).

While maintaining the resulting state, the diameter of coalesced particles was measured employing a "Coulter Counter TA-II". When the volume average particle diameter reached 5.5 μm, the growth of particles was terminated by the addition of an aqueous solution prepared by dissolving 80.4 g of sodium chloride in 1000 ml of deionized water, and further fusion was continually carried out at a liquid media temperature of 85±2° C. for 0.5 to 15 hours depending on Colored Particle samples, while being heated and stirred (digestion process). Thereafter, the temperature was decreased to 30° C. at a rate of 8° C./minute. Subsequently, the pH was adjusted to 2.0, and stirring was terminated. The resulting coalesced particles were collected through filtration through a glass filter, and washed with deionized water. Washed particles were then dried by flush jet dryer with inlet air temperature at 60° C., and dried by fluidized-bed layer dryer at 60° C., thus colored particles.

Colored Particle samples 1 to 7 having particle characteristics shown in Table 2 were obtained by changing temperature and time of salting/fusing and shape control step.

Toner samples 1-7 were prepared by adding aliphatic acid metal salt, abrasive outer additive, and outer additive, and they were mixed for 10 minutes by means of 10 L Henschel mixer with peripheral speed of the rotor blade at 40 m/sec.

Particle diameter, shape coefficient, variation coefficients and so on are shown in Table 2.

TABLE 2

| Toner, Developer No. | Number average particle size of toner (μm) | Ratio of Toner Particles having particle size less than 3.17 μm (%) | Shape Factor: Ratio of Toner Particles having particle size of 1.0-1.6 μm (%) | Shape Factor: Ratio of Toner Particles having particle size of 1.2-1.6 μm (%) | Shape Factor: Variation Coefficient (%) | Ratio of Toner Particles without Corners (%) | Number Variation Coefficient of Toner Particles (%) | M ($m_1 + m_2$) (%) |
|---|---|---|---|---|---|---|---|---|
| 1 | 4.2 | 3.1 | 74.1 | 65.8 | 15.8 | 61 | 24.2 | 70.8 |
| 2 | 5.4 | 2.6 | 67.1 | 65.4 | 15.4 | 52 | 24.5 | 71.2 |
| 3 | 8.8 | 3.4 | 70.1 | 65.1 | 15.2 | 55 | 26.4 | 72.7 |
| 4 | 5.8 | 8.6 | 63.1 | 59.1 | 19.4 | 41 | 28.9 | 67.5 |
| 5 | 5.7 | 0.8 | 53.9 | 42.8 | 30.4 | 39 | 32.5 | 38.6 |
| 6 | 3.5 | 8.6 | 61.1 | 59.1 | 19.4 | 41 | 28.9 | 67.5 |
| 7 | 9.4 | 0.8 | 48.1 | 42.8 | 30.4 | 39 | 32.5 | 38.6 |

Production of Carrier

Production of Ferrite Core Materials

In a wet type ball-mill, 22 mol percent of MnO, and 78 mol percent of $Fe_2O_3$ were crushed and mixed for two hours and dried. Thereafter, the resulting mixture was maintained at 900° C. for two hours to be subjected to preliminary burning and was crushed for 3 hours in a ball mill to form a slurry. Subsequently, dispersing agents and binders were added and the resulting mixture was granulated employing a spray drier, followed by drying. Thereafter, the main burning was carried out at 1,200° C. for 3 hours, whereby ferrite core martial particles of a resistance value of $4.3\times10^8$ Ω·cm were prepared.

Initially, a cyclohexyl methacrylate/methyl methacrylate copolymer (at a copolymerization ratio of 5/5) was synthesized in an aqueous solution media comprising sodium benzenesulfonate having an alkyl group with 12 carbon atoms as a surface active agent at a concentration of 0.3 percent by weight, by employing an emulsion polymerization method. Thus, prepared were minute resinous particles at a volume average primary particle diameter of 0.1 mm, a weight average molecular weight (Mw) of 200,000, a number average molecular weight (Mn) of 91,000, an Mw/Mn of 2.2, a softening point temperature (Tsp) of 230° C., and a glass transition temperature (Tg) of 110° C.

Subsequently, charged into a high speed stirring mixer fitted with stirring blades were 100 parts by weight of ferrite core material particles and 2 parts by weight of the aforesaid resinous particles and mixed while stirring at 120° C. for 30 minutes, whereby resin-coated carrier of a volume average particle diameter of 61 μm was prepared utilizing mechanical impact force.

Production of Developing Agent

The toner samples were blended with the carrier, whereby developing agents 1-7 at a toner concentration of 6 percent by weight were prepared.

Evaluation test was performed by employing photoreceptor samples 1-11 in combination with developer samples 1-7 as shown in Table 3.

Samples were evaluated by copying 100,000 sheets of an original document having four equal quarter parts of a text having a pixel ratio of 7 percent, a portrait, a solid white image, and a solid black image, employing A4 neutral paper sheets.

Developing Condition

DC bias: −100 V

Dsd (Distance between photoreceptor and developer sleeve): 600 μm

Developer layer thickness regulation: Magnetic H-Cut

Developer layer thickness; 700 μm

Diameter of developer sleeve: 40 mm

Toner image was fixed by means of thermal fixer. Residual toner on a photoreceptor was removed by urethane rubber.

Paper sheets having a basis weight of 55 kg were employed as transfer paper.

Densitometer "RD-918" (manufactured by Macbeth Corp.) was employed.

Evaluation Items and, Evaluation Criteria

Image Unevenness at Edges:

Evaluated by the density difference in halftone images (ΔHD=density of 1 cm portion at the edge−density of the central portion)

A: less than or equal to 0.05 (good)

B: more than 0.05 to less than 0.1 (commercially viable level)

C: more than or equal to 0.1 (commercially unviable)

Black Spots

A: the number of 0.4 mm or larger black spots: 3 or less/A4 n all image prints

B: the number of 0.4 mm or larger black spots: formation of at least one sheet having 4 or more to 19 or less/A4 (commercially viable level)

C: the number of 0.4 mm or larger black spots: formation of at least one sheet having 20 or more/A4 (commercially unviable level)

Layer Peeling at Edges:

After completion of continuous printing, the photoreceptor edges were observed and photosensitive layer peeling at the edges was inspected.

A: no layer peeling at edges was noticed

B: slight layer peeling at edges was noticed but was commercially viable

C: layer peeling at edges was noticed and was commercially unviable

Toner Stain

After printing 10,000 sheets, the image forming apparatus and the photoreceptor surface were observed and toner stain was inspected.

A: no toner scattering was noticed

B: slight toner scattering was noticed but was in the commercially viable level

C: toner scattering was noticed and was in the commercially unviable level

Resolution: Evaluated by fine line image

Sharpness was evaluated by 10 generation copying of a 9.6 point Minchyo (Ming-style) font of certain Chinese characters, and readable test observed by 10 persons were performed and average readable generation was determined.

A: Over 9 generations (good)

B: 5-8 generations (practically viable level)

C: Not more than 4 generations(practically unviable level)

Blade Worn

Cleaning blade was removed from the apparatus after 100,000 sheets copying, and its front edge was observed via laser microscope to find reduced length. The reduced length less than 15 mm is acceptable.

In Sufficient Cleaning at the Center Area of the Image

Surface of the photoreceptor after 100,000 sheets copying was observed to find insufficient cleaning in a wave shape.

A: No insufficient cleaning was observed.

B: Scarcely insufficient cleaning was observed but not observed on the final transferred image (practically viable level).

C: Image stain of fine mottle was observed on the final transferred image (practically unviable level).

The results are shown in Table 3.

TABLE 3

| Example | Drum No. | Toner No. | Uneven image at end portion | Toner stain | Image Defect | Layer Peeling at Edges | Blade Worn (μm) | Resolution | Wave-like Cleaning Defect |
|---|---|---|---|---|---|---|---|---|---|
| 1 | 1 | 1 | A | A | A | A | More than 15 | A | A |
| 2 | 2 | 1 | A | A | A | A | More than 15 | A | A |
| 3 | 3 | 1 | A | A | A | A | More than 15 | A | A |
| 4 | 4 | 2 | A | A | A | A | More than 15 | A | A |
| 5 | 5 | 2 | A | A | A | A | More than 15 | A | A |
| 6 | 6 | 2 | A | A | A | A | More than 15 | A | A |
| 7 | 7 | 3 | A | A | A | A | More than 15 | B | A |
| 8 | 8 | 3 | A | A | A | A | More than 15 | B | A |
| 9 | 9 | 3 | C | C | C | C | 30 | B | C |
| 10 | 10 | 2 | B | B | B | C | 15 | B | C |
| 11 | 11 | 2 | C | C | C | C | 32 | B | C |
| 12 | 4 | 4 | B | B | C | B | 28 | B | C-B |
| 13 | 4 | 5 | B | C | B | B | 16 | B | C |
| 14 | 4 | 6 | B | B | C | B | 28 | B | C-B |
| 15 | 4 | 7 | B | C | B | B | 15 | C | C |

Table 3 shows that samples 1-8 have sufficient property of image unevenness, wave-like cleaning defect at the center image portion, toner stain, black spots, peeling at the end portion blade worn etc.

The invention claimed is:

1. A method of forming a toner image, comprising:

electrically charging a photoreceptor;

imagewise exposing the photoreceptor so that a latent image is formed on the photoreceptor;

developing the latent image with toner so that a toner image is formed on the photoreceptor;

transferring the toner image on an image forming material; and removing a residual toner on said electrophotographic photoreceptor;

the photoreceptor comprises a photosensitive layer on a cylindrical conductive substrate, Formula (1) and Formula (2) are held, $$P<Pmax<2P \quad \text{Formula (1)}$$

$$2\leqq(Pmax/D)\times100<50 \quad \text{Formula (2)}$$

wherein P (μm) is the average of the coating layer thickness in central section in the width direction of the photoreceptor, Pmax (μm) is average of the maximum value of the layer thickness out of the image forming region, and D (μm) is average of distance between point, at which said maximum value is obtained, and edge of the coating layer, and the toner contains 1.0 to 7.0 number % of toner particles having number based particle diameter not more than 3.17 μm based on whole number of toner particles, and number average toner particle diameter is 4-9 μm.

2. The method of claim 1, wherein the toner has variation coefficient of shape coefficient is not more than 16 percent.

3. The method of claim 1, wherein the toner has number variation coefficient in the toner number size distribution is not more than 27 percent.

4. The method of claim 1, wherein the charging member is a charging roller.

5. The method of claim 1, wherein the toner has number ratio of toner particles having no corners is 50 percent or more.

6. The method of claim 1, wherein the toner has sum M of $m_1$ and $m_2$ is at least 70 percent, wherein $m_1$ is the relative frequency of toner particles included in the highest frequency class in a histogram, showing the particle size distribution based on the number of particles, in which, when E (in μm) represents the diameter of a toner particle, natural logarithm 1 nE is taken as the abscissa and a plurality of classes at an interval of 0.23 is taken as the ordinate, and $m_2$ is the relative frequency of toner particles included in the second highest frequency class in the histogram, and the toner has a number variation coefficient of toner particles of at most 27 percent.

7. The method of claim 1, wherein the toner has number variation coefficient in the toner number size distribution is not more than 27 percent, and the toner has number ratio of toner particles having a shape coefficient of 1.2 to 1.6 and is at least 65 percent.

8. The method of claim 1, wherein the photoreceptor has a layer prepared by coating composition comprising a photosensitive material and removing a part of the layer.

9. The method of claim 8, wherein a part of the photosensitive layer is removed by making a rubbing means brought into contact with the photosensitive layer.

10. The method of claim 9, wherein the rubbing means is a brush.

11. The method of claim 9, wherein the rubbing means is a tape.

12. The method of 1, wherein the residual toner on said electrophotographic photoreceptor is removed by urethane rubber blade cleaning means.

13. The method of claim 1, wherein P is from 15 to 35 μm.

* * * * *